US005947552A

United States Patent [19]

Wilkins et al.

[11] Patent Number: 5,947,552

[45] Date of Patent: Sep. 7, 1999

[54] COLLAPSIBLE BASSINET/INFANT SEAT WITH CANOPY

[75] Inventors: Julia Wilkins, Buffalo; John S. Canna, Orchard Park; Sandra M. Darling, East Aurora; Kenneth Von Felten, Marietta, all of N.Y.

[73] Assignee: Mattel, Inc., El, Segundo, Calif.

[21] Appl. No.: 08/911,524

[22] Filed: Aug. 14, 1997

[51] Int. Cl.[6] ..... A47D 13/00

[52] U.S. Cl. ..... 297/16.1; 297/19; 297/50; 5/94

[58] Field of Search ..... 297/16.1, 19, 46, 297/47, 50, 52, 54; 5/110, 111, 112, 114, 94, 655

[56] References Cited

U.S. PATENT DOCUMENTS

| | | | |
|---|---|---|---|
| D. 167,514 | 8/1952 | Hicks . | |
| D. 325,132 | 4/1992 | Cone . | |
| 1,568,063 | 1/1926 | Fagen . | |
| 2,300,425 | 11/1942 | Kiesow | 5/94 X |
| 2,636,548 | 4/1953 | Berlin | 5/94 X |
| 2,668,302 | 2/1954 | Engrove . | |
| 2,709,478 | 5/1955 | Golding et al. | 5/94 X |
| 2,938,572 | 5/1960 | Solloway | 5/111 X |
| 2,949,628 | 8/1960 | Koltun | 5/94 X |
| 3,004,793 | 10/1961 | Loomis . | |
| 3,049,727 | 8/1962 | Ruddy . | |
| 3,115,364 | 12/1963 | Berlin . | |
| 3,261,033 | 7/1966 | Martin . | |
| 3,453,022 | 7/1969 | Lecuyer | 297/46 |
| 4,478,453 | 10/1984 | Schutz . | |
| 4,681,096 | 7/1987 | Cuervo . | |
| 4,856,130 | 8/1989 | Berkovich . | |
| 4,869,554 | 9/1989 | Abu-Isa et al. . | |
| 4,889,383 | 12/1989 | Jones | 297/16.1 |
| 4,921,301 | 5/1990 | Haynes . | |
| 4,967,432 | 11/1990 | Kujawski et al. . | |
| 4,998,307 | 3/1991 | Cone . | |
| 5,052,749 | 10/1991 | Groenendijk . | |
| 5,092,004 | 3/1992 | Cone et al. . | |
| 5,115,523 | 5/1992 | Cone . | |
| 5,207,478 | 5/1993 | Freese et al. . | |
| 5,441,328 | 8/1995 | Snyder . | |
| 5,464,381 | 11/1995 | Wilson . | |
| 5,496,094 | 3/1996 | Schwartzkopf et al. . | |
| 5,503,458 | 4/1996 | Petrie . | |
| 5,590,896 | 1/1997 | Eichhorn . | |
| 5,617,594 | 4/1997 | Chien . | |
| 5,660,435 | 8/1997 | Eichhorn . | |

FOREIGN PATENT DOCUMENTS

| | | | |
|---|---|---|---|
| 51162 | 5/1982 | European Pat. Off. | 297/16.1 |
| 2566252 | 6/1984 | France . | |
| 270503 | 12/1950 | Switzerland . | |
| 836778 | 6/1960 | United Kingdom . | |
| 2163045 | 2/1986 | United Kingdom . | |

OTHER PUBLICATIONS

Fisher–Price 3–In–1 Travel Tender With Bassinet, 2 pgs., Spring, 1993.

Arm's Reach and White Eyelet Bassinet, Right Start Catalog, 3 pgs.

*Primary Examiner*—Peter R. Brown

*Attorney, Agent, or Firm*—Morgan, Lewis & Bockius LLP

[57] ABSTRACT

The infant product of the invention is of the type having an infant receptacle suspended from a frame. The infant product is foldable between a deployed position for use and a compact configuration for shipping and storage. In the assembled configuration, the infant receptacle is convertible between a bassinet configuration in which the infant receptacle has a substantially planar support surface and an infant seat configuration in which the support surface of the infant receptacle is partially titled or disposed at an angle such that the infant can be supported in an elevated or seated position. The infant product may include a fabric canopy incorporating floating webs and a quick connect system for securing the canopy in an open position. When the canopy is closed, it is folded so as to lie flat against the infant receptacle. The infant receptacle may also include a lateral support assembly to cradle the infant.

36 Claims, 26 Drawing Sheets

COLLAPSIBLE BASSINET/INFANT SEAT WITH CANOPY

FIELD OF THE INVENTION

This invention relates to a convertible infant product and, more particularly, to a collapsible bassinet/infant seat having a canopy.

BACKGROUND OF THE INVENTION

Sleep products are generally tailored to the age and size of the user. Infants generally start out sleeping in a bassinet or cradle. Toddlers use cribs up until they are ready to sleep in a conventional bed.

Bassinets and cradles are generally small and can be kept in a parent's room so that the infant is close to the parents during its first few months. Known bassinets and cradles are not collapsible into a compact configuration and only function as sleep products. Moreover, bassinets and cradles have a limited life and use because they are quickly outgrown by infants. However, cribs are generally too large to fit into a parent's room. Thus, there is a need for a smaller sleep product for use in a parent's room that has a sleep surface and sufficient depth to laterally restrain the infant during use, but that overcomes the limited life and use associated with known bassinets and cradles.

U.S. Pat. No. 4,967,432 to Kujawski et al., which is assigned to the assignee of this invention, discloses a multi-use product including a bassinet and playpen in one product. The playpen is of the type including a frame covered by playpen fabric. The flat bassinet/diaper changing surface is inset into the open end of the playpen to make it more accessible for naps and diaper changing. The bassinet/diaper changing surface is a fabric enclosure with a rigid floor mat. The fabric is draped over the upper edge of the playpen and rigid hook-shaped clips sewn to the fabric are secured to the upper edge of the playpen. As this product is on the scale of a playpen, it is larger than a bassinet.

In the vein of portability, but apart from sleep products, infant seats are available that are usually formed from rigid shells that are portable but not collapsible into a compact configuration. In one type of infant seat proposed in U.S. Pat. Nos. 5,115,523; 5,092,004; and 4,998,307 all to Cone, the infant seat includes a rigid shell assembly having upper and lower shell portions pivotally coupled together so as to be convertible between a flat configuration and a seated configuration. Although this seat is portable it is cumbersome and is not collapsible into a compact configuration.

Known bouncer seats of the type disclosed, for example, in U.S. Pat. No. 5,207,478 to Freese et al. include a portable infant seat where the back is convertible between an upright and a tilted position. Although these bouncer seats can be collapsed for portability, they are not intended for use as a sleep product, for example, they are not convertible into a horizontal position.

Accordingly, what is needed is a small, lightweight, collapsible infant product that has a range of utilities including a sleep product and a seating product.

SUMMARY OF THE INVENTION

The invention is generally directed to an infant product. An aspect of the invention is directed to the combination bassinet/infant seat feature. In particular, the infant product includes a frame having an infant receptacle suspended from the frame. The infant receptacle is convertible between a bassinet configuration and an infant seat configuration. This conversion between the reclined and upright configurations may be accomplished using only parts of the soft goods. In the bassinet configuration, the support surface of the infant receptacle is substantially planar, such that the infant is positioned in a reclined or flat position. In the infant seat configuration, the back portion of the infant support surface may be tilted or disposed at an angle whereby the infant can be supported in an elevated or seated position. In one aspect of the invention, this conversion is accomplished through the use of a support strap assembly. In yet another aspect of the invention, the support strap assembly and infant support surface cooperate to provide improved lateral head support for the infant.

In another aspect of the invention, the infant product is foldable or collapsible, such that the infant product is convertible between an assembled configuration for use with the infant in either of the reclined or upright positions just described and a compact collapsed configuration for travel and storage. In one aspect of the invention, a simple three-step folding method may be used to convert the infant product between the assembled erect position and compact folded configurations. The suspended soft goods are folded-up along with the frame. Moreover, part of the frame that is used to support the infant product in the assembled erect position serves the dual purpose as a handle in the compact configuration. A lightweight carrying case may be provided to cover the main portion of the compact infant product.

In yet another aspect of the invention, the infant product may include a canopy. The canopy is of the type made of a fabric having floating ribs or stays disposed in tunnels sewn into the fabric of the canopy. With the use of a quick connect system, the canopy can be easily converted between an expanded open position and a closed position.

Other features and advantages of this invention will be apparent from the following description, the accompanying drawings and from the appended claims.

DETAILED DESCRIPTION OF PREFERRED EMBODIMENTS

Figure 1:
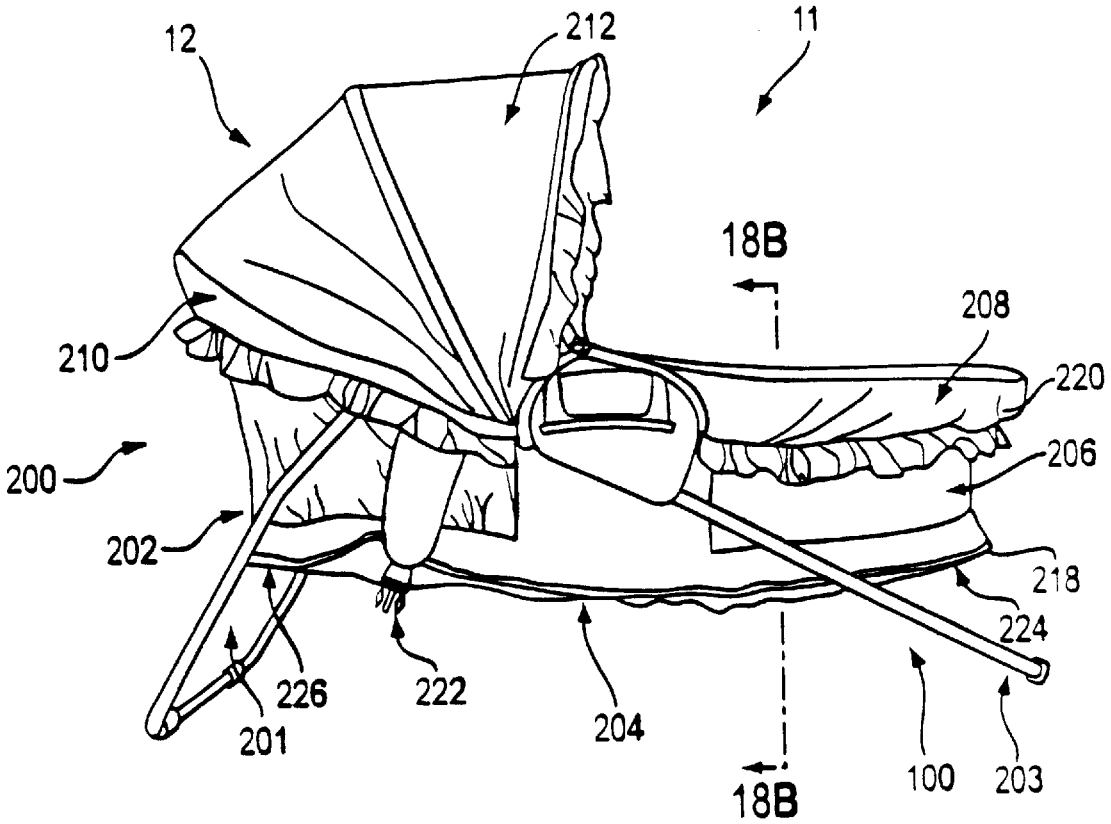
FIGS. 1–4 are side, front end, back end, and top front perspective views, respectively, of the infant product in accordance with the invention in the assembled bassinet position.
Figure 2:
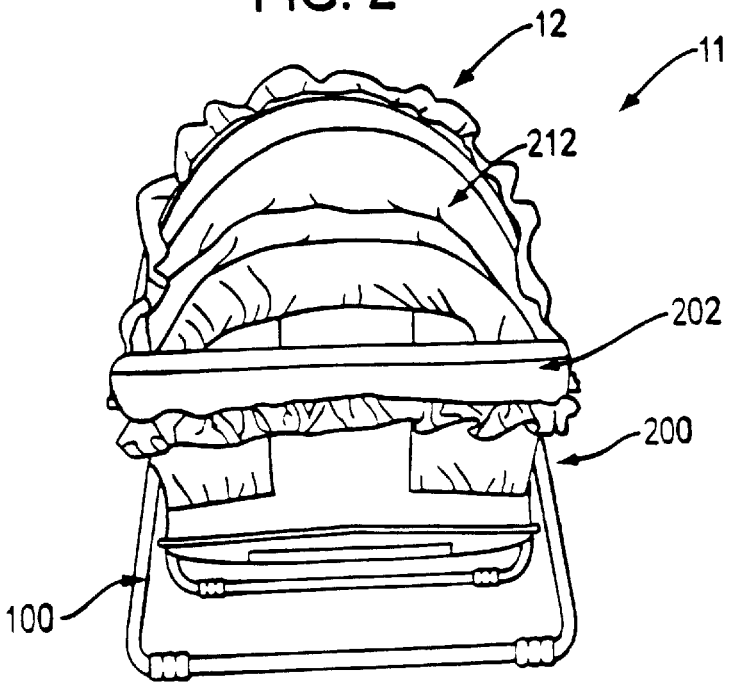
Figure 3:
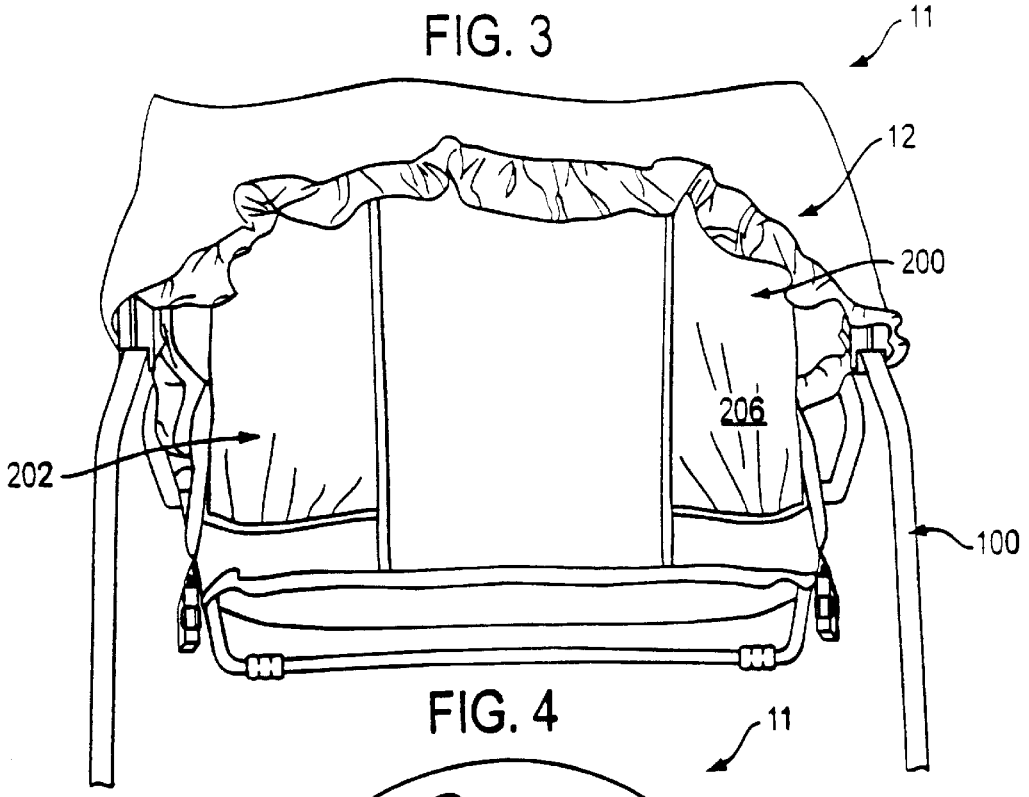

Reference will now be made in detail to the presently preferred embodiments of the invention, examples of which are illustrated in the accompanying drawings. In particular, the invention is directed to an infant product, the presently preferred embodiments of which are shown generally in FIGS. 1, 5 and 31, for example. More particularly, the infant product in accordance with the invention is directed to: 1) a collapsible infant product that is configurable between: a) an in-use, deployed or unfolded configuration, shown generally at 11 in FIGS. 1–9 and b) a storage, stowed or folded configuration shown generally at 16 in FIGS. 27–31, and 2) deployed infant product 11, which may be disposed in either of two configurations: a) a deployed bassinet configuration shown generally at 12 in FIGS. 1–4, and b) an deployed infant seat configuration shown generally at 14 in FIGS. 5–9.

Regardless of the respective configuration, however, the infant product in accordance with the invention includes a foldable frame shown generally 100 in FIGS. 10–14 and soft goods shown generally at 200 in FIGS. 1–9 which are suspended from frame 100. Accordingly, a detailed discussion of frame 100 and soft goods 200 follows. Then, the method of converting the infant product between deployed bassinet configuration 12 and deployed infant seat configuration 14 will be described, as well as, the conversion between deployed configuration 11 and compact folded configuration 16.

The Foldable Frame

Figure 10:
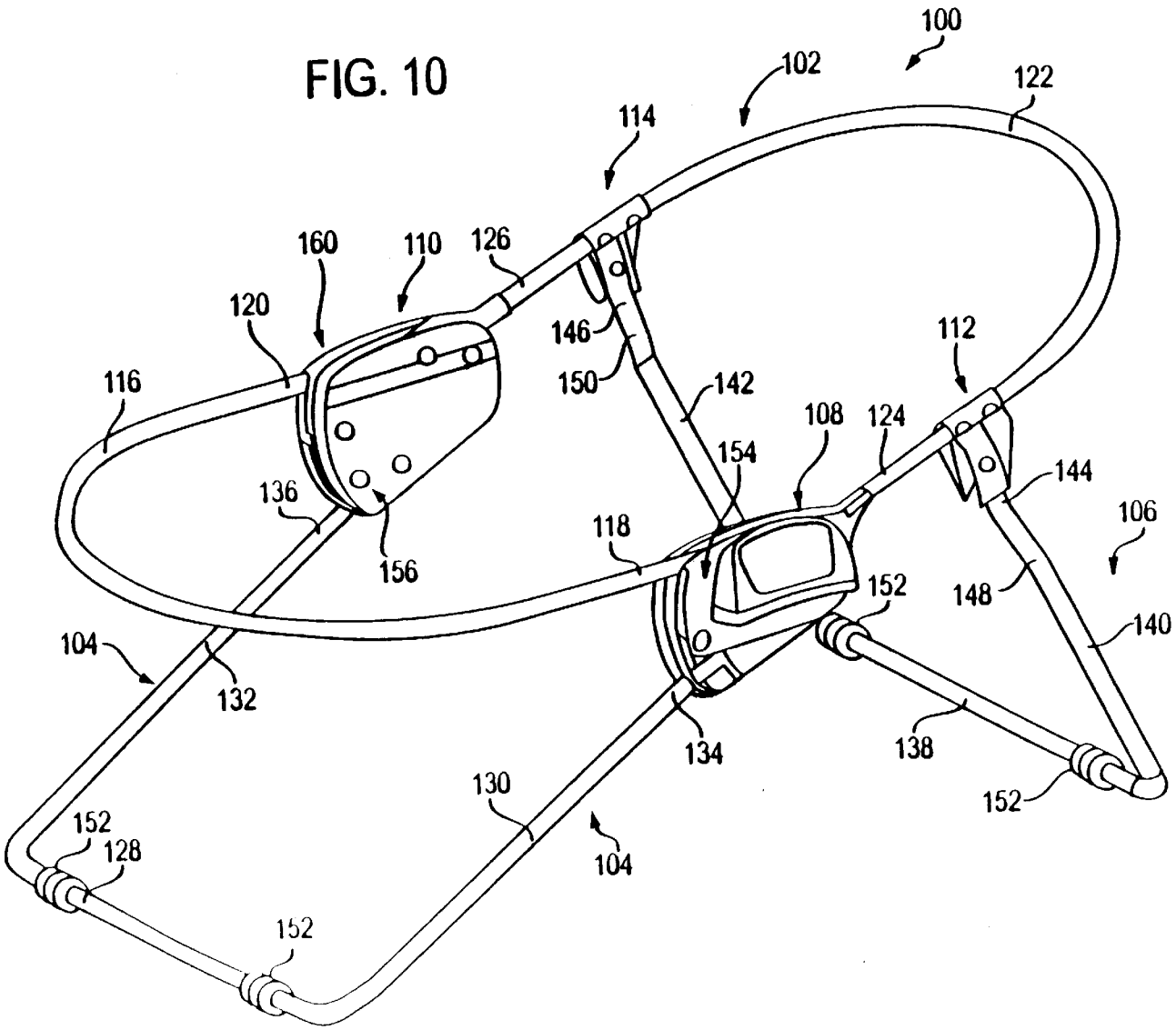
FIGS. 10–12 are perspective front end, perspective back end, and side views, respectively, of the frame for the infant product in accordance with the invention.
Figure 11:
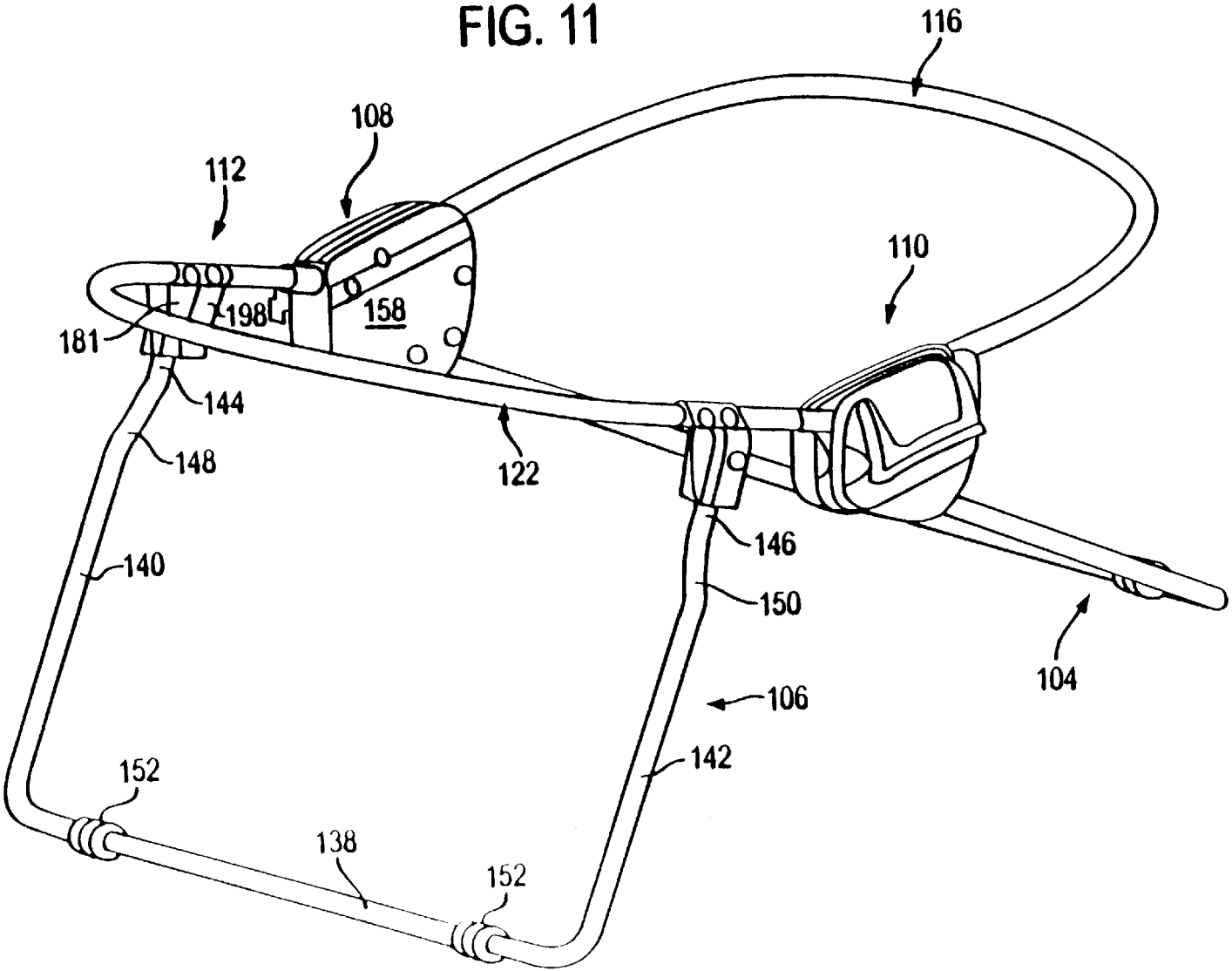
Figure 12:
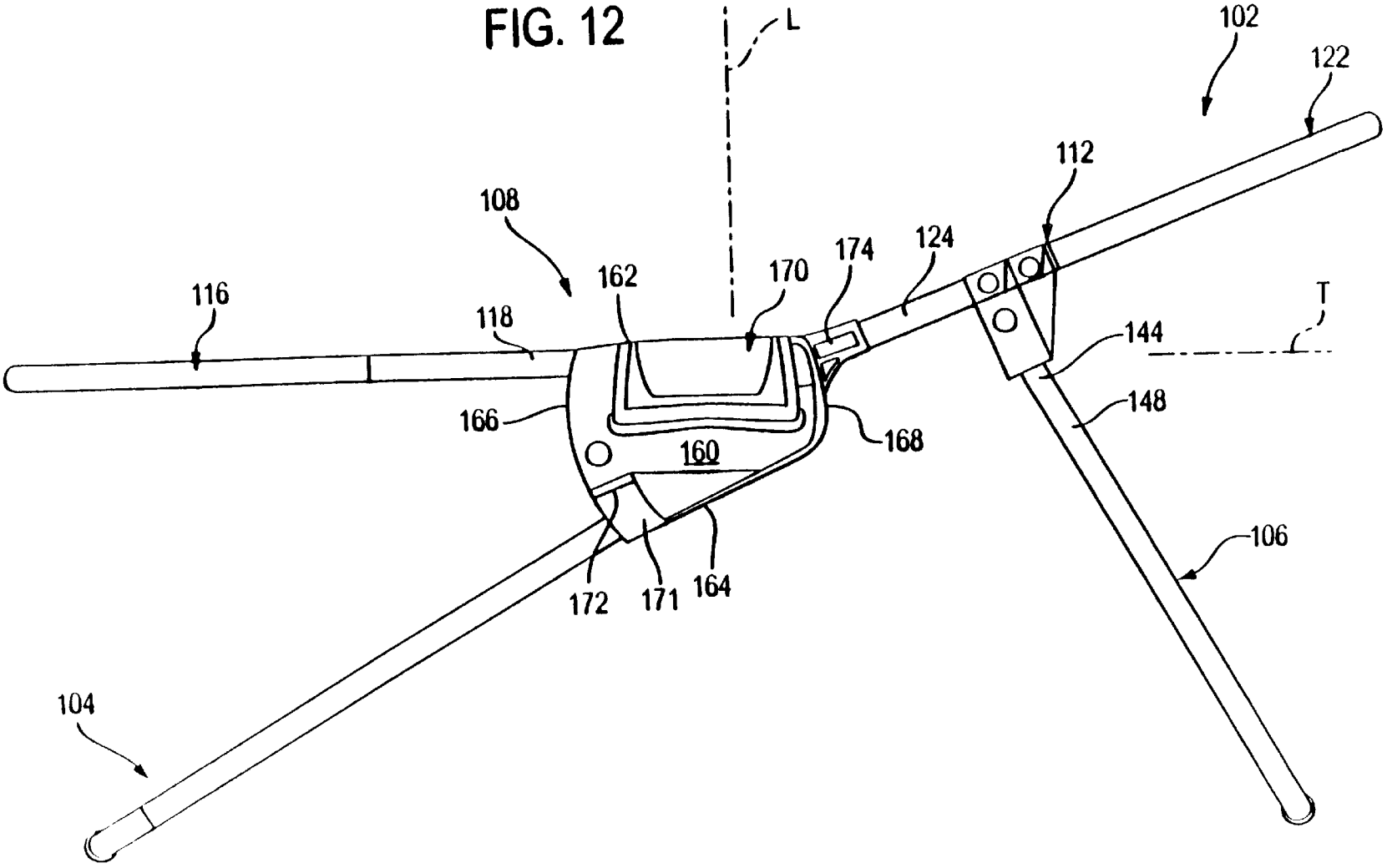

Referring now to FIGS. 10–14, frame 100 will be described. Frame 100 has a construction that suspends soft goods 200 and is convertible between deployed configuration 11 as shown in FIGS. 10–12, for example, and compact folded configuration 16 as shown, for example, in FIG. 27. Frame 100 is preferably converted by folding frame 100 along with soft goods 200. Therefore, the frame is not limited to a particular configuration so long as it can suspend soft goods 200 and can be easily converted between a compact configuration and a deployed configuration in accordance with the invention.

Frame 100 has a longitudinal axis L (FIG. 12) and a transverse axis T substantially perpendicular to longitudinal axis L. As shown, frame 100 generally includes an annular upper rim frame 102, a front leg 104, a back leg 106, structural hubs 108, 110 and back leg brackets 112, 114.

Annular upper rim frame 102, front leg 104 and back leg 106 may be made of any lightweight rigid and durable material. In the illustrated embodiment, these members are 18-gauge, powder-coated, hollow, cylindrical steel tubing. Upper rim frame 102 may have a 0.5" (1.2 cm) outer diameter and front and back legs 104, 106 may have ⅝" (1.7 cm.) outer diameter. However, other types of materials may be used in accordance with the invention, such as rectangular tubing, aluminum, wood, or plastic tubing or channel, etc.

Annular upper rim frame 102 provides the support from which soft goods are suspended. Annular upper rim frame 102 as shown includes a front rim tube 116 and a back rim tube 122, both of which have a generally U-shaped configuration. Front rim tube 116 has two ends 118, 120 pivotally coupled to structural hubs 108, 110, respectively, such that front rim tube 116 is pivotal relative to back rim tube 122 as discussed in more detail below. Back rim tube 122 has two ends 124, 126 non-pivotally secured to structural hubs 108, 110 as discussed in more detail below. As illustrated in FIG. 12, in the deployed position front rim tube 116 is disposed substantially parallel to transverse axis T, while back rim tube 122 is disposed at an angle relative to front rim tube 116. Back rim tube 122 is disposed at a slight angle such that infant recline/seat feature 222 (see, e.g. FIGS. 17 and 18) can be positioned high enough to form deployed infant seat configuration 14, as discussed in more detail below. However, other configurations are within the scope of the invention to accommodate infant recline/seat feature 222, and if the recline/seat feature 222 is not used, back rim tube 122 may also be parallel to transverse axis T.

Front leg 104 and back leg 106 are disposed to support annular upper rim frame 102 in deployed configuration 11 at a suitable height above a supporting surface to suspend soft goods 200 above the supporting surface. For example, front and back legs 104, 106 are disposed at angles opposing each other, with their upper ends relatively close together and their lower, support-surface engaging ends relatively far apart to provide a broad, stable base. Front leg 104 has a generally U-shaped configuration including a base 128 and two side legs 130, 132 extending substantially perpendicular from base 128. Side legs 130, 132 have ends 134, 136 respectively, which are pivotally attached to structural hubs 108, 110, respectively, as discussed in more detail below. Back leg 106 is also of a generally U-shaped configuration and includes a base 138 including two side legs 140, 142 extending substantially perpendicular from base 138. Side legs 140, 142 have two ends 144, 146 respectively, pivotally attached to back leg brackets 112, 114, respectively, as discussed in more detail below. Side legs 140, 142 of back leg 106 include transition portions 148, 150 in the vicinity of ends 144, 146 whereby the lateral spacing or distance between side legs 140, 142 is increased such that back leg 106 does not interfere with the folding movement of front leg 104 (front leg 104 pivots inside of back leg 106) and such that back leg 106 can detent against the outside of structural hubs 108, 110 in compact folded configuration 16 as discussed later. Although front and back legs 104, 106 have been described as being pivotally coupled relative to upper rim frame 102, any type of releasable connection may be used.

To increase resistance to sliding of the legs with respect to the support surface in deployed configuration 11, rubber feet 152 may be disposed, two each, on bases 128, 138 of back leg 106 and front leg 104, respectively. Rubber feet 152 may be formed of any rubber material including, for example, a synthetic rubber such as a thermoplastic elastomers (TPE). Rubber feet 152 also prevent the infant product in its deployed configuration 11 from shifting or "walking," for example, when a vibration unit is used, as discussed below.

Annular upper rim frame 102, front leg 104 and back leg 106 just described are deployed and interconnected using structural hubs 108, 110 and back leg brackets 112, 114. Accordingly, structural hubs 108, 110 and back leg brackets 112, 114 will now be discussed in detail along with the assembly of frame 100. Structural hubs 108, 110 and back leg brackets 112, 114 may be made of a lightweight plastic material, such as, structural nylon.

Figure 13:
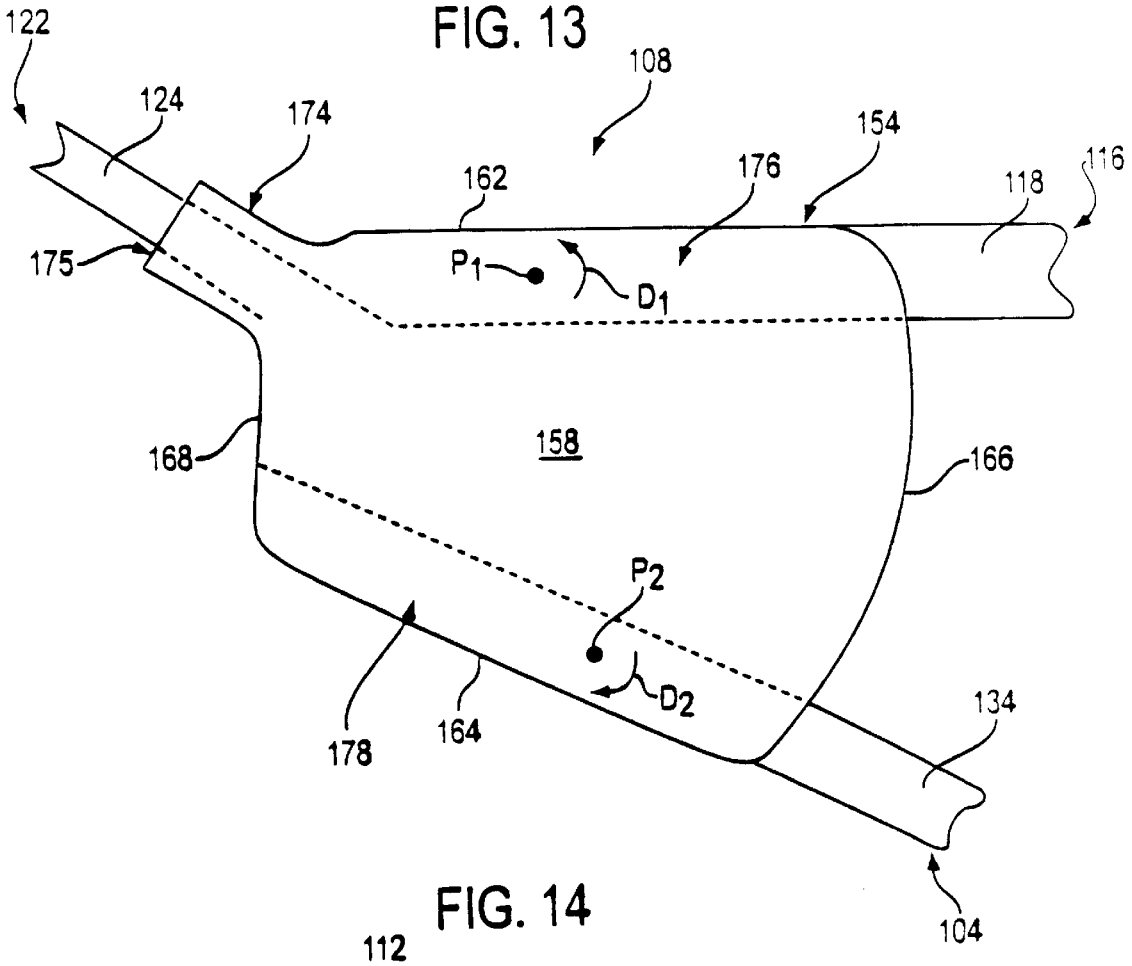
FIG. 13 is a side view of one of the structural hubs which forms part of the frame of FIGS. 10–12.

Referring now to FIG. 13 in combination with FIGS. 10–12, structural hubs 108, 110 will be discussed in detail. Structural hubs 108, 110 include hollow box-shaped housings 154, 156. One of structural hubs 108, 1 10 may include a vibration unit integrated into its housing 154, 156 to sooth the infant. Such a vibration unit may include, for example, a motor, a weight, an on/off switch, battery contacts and wiring. It is preferable to place the vibration unit on one of structural hubs 108, 110 because structural hubs 108, 110 are in structural communication with the entire frame 100 and therefore distribute the vibration most effectively, however, other configurations may be used in accordance with the invention.

As structural hubs 108, 110 are laterally disposed on frame 100, they are mirror images of each other. Accordingly, the following discussion only describes structural hub 108 in detail, because the construction of structural hub 110 is readily apparent from the detailed description of structural hub 108.

Housing 154 of structural hub 108 includes an interior side wall 158 and an exterior side wall 160 (FIG. 12) opposing and substantially parallel to interior side wall 158. Housing 154 further includes an upper side 162 substantially parallel to transverse axis T, a lower side 164 disposed at an angle relative to transverse axis T, front side 166 and back side 168. Other configurations are within the scope of the invention.

Exterior side wall 160 includes a carrying handle 170 formed integrally therewith and extending outwardly therefrom. Carrying handle 170 includes a recess on its lower side for being gripped by the hand such that the infant product in deployed configuration 11 may be moved. Carrying handle 170 is preferably positioned such that it is at or near the center of gravity of deployed configuration 11 when the infant is in the infant product. Exterior side wall 160 further includes a detent 171, formed as, for example, a slightly raised surface area, and an abutment portion 172 (FIG. 12) to position and releasably hold back leg 106 in compact folded configuration 16, as discussed in more detail below.

The upper end of back side 168 of housing 154 is adapted to fixedly mount end 124 of back rim tube 122. For example, housing 154 may include hollow tubular projection 174 having a hollow tubular opening 175 to receive end 124 of back rim tube 122. Hollow tubular opening 175 extends though projection 174 and into the interior of housing 154 for a distance sufficient to adequately support back rim tube 122, and has an inner diameter substantially equal to the outer diameter of end 124 of back rim tube 122. End 124 of back rim tube 122 is slidably disposed within hollow tubular projection 174 and may be secured by a screw (not shown), for example.

At upper side 162 of housing 154 is formed a channel 176 extending substantially parallel to transverse axis T and between front side 166 and back side 168. End 118 of front rim tube 116 is pivotally secured to housing 154 within channel 176 by a known pivotal connector, such as, a pin. This pivotal attachment is represented in FIG. 13 by pivot point $P_1$. In deployed configuration 11 of the infant product, front rim tube 116 is positioned within channel 176 as shown so as to extend substantially parallel to transverse axis T. As discussed in greater detail below, to collapse the deployed infant product, front rim tube 116 is rotated about pivot point $P_1$ in the direction illustrated by the directional arrow $D_1$. Accordingly, to deploy the infant product, front rim tube 116 would be rotated from its compact folded configuration 16 in a direction opposite to directional arrow $D_1$ into deployed configuration 11 as shown.

Lower side 164 of housing 154 includes another channel 178 extending between front side 166 and back side 168 of housing 154. Channel 178 extends at an angle relative to transverse axis T. For example, this angle may be approximately 35° from transverse axis T. End 134 of front leg 104 is pivotally attached to housing 154 within channel 178 using any known pivotal connector. This pivotal attachment is illustrated by pivot point $P_2$. To collapse the deployed infant product, front leg 104 is pivoted about pivot point $P_2$ in the direction illustrated by directional arrow $D_2$ until front leg 104 is disposed in a position opposing the position shown in FIG. 13 (i.e. 180°), as will be discussed in greater detail below.

Figure 14:
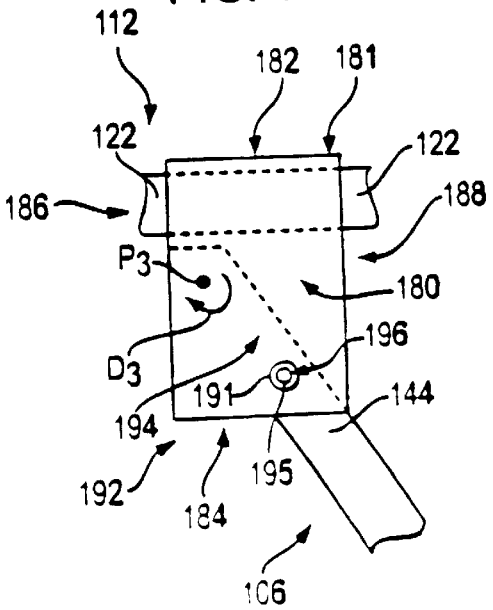
FIG. 14 is a side view of a leg bracket used in the frame of FIGS. 10–12.

Referring now to FIG. 14, back leg brackets 112, 114 will be discussed. Back leg brackets 112, 114 are disposed laterally on frame 100 and are mirror images of each other. Accordingly, only back leg bracket 112 will be discussed in detail as the construction of back leg bracket 114 will be readily apparent from the discussion of back leg bracket 112.

Back leg bracket 112 includes an exterior side wall 180, an interior side wall 181 (see also FIG. 11), an upper end 182, a lower end 184, a front end 186 and a back end 188. At upper end 182 it is formed a hollow tubular sleeve through which back rim tube 122 is slidably disposed. In corner 192 between lower end 184 and front end 186 is formed a channel 194 disposed at an angle, for example, 45°, relative to transverse axis T to support back rim tube 122. End 144 of back leg 106 is pivotally attached to back leg bracket 112 and is disposed within channel 194 when back leg 106 is disposed in deployed configuration 11 of the infant product. End 144 of back leg 106 is pivotally attached to back leg bracket 112 by any known pivotal connector. This pivotal connection is represented in FIG. 14 by pivot point $P_3$.

As discussed in detail below, when deployed configuration 11 is collapsed, back leg 106 is pivoted about pivot point $P_3$ in the direction represented by directional arrow $D_3$. Accordingly, to position back leg 106 in deployed configuration 11 from compact folded configuration 16, back leg 106 is moved in a direction opposite to the direction represented by directional arrow $D_3$ until its detents on detent 171 on exterior sidewall 160 of housing 154. As discussed below, in compact folded configuration 16, back leg 106 is disposed substantially parallel to back rim tube 122.

A detent 198 (FIG. 11) is also formed on interior side wall 181 of back leg bracket 112 to releasably secure front leg 104 in compact folded configuration 16. For example, detent 198 may include a raised surface or a raised surface with a depression corresponding to the shape of front leg 104.

To properly and releasably position back leg 106 relative to back rim tube 122 in the deployed configuration, a spring or Valco button connection 196 may be used. In particular, spring button connection 196 includes spring button 195 formed on end 144 of rear leg 106 that is spring biased in an extended position, and a hole 197 formed in exterior side wall 180 of back leg bracket 112. As back leg 106 is rotated into its assembly configuration, spring button 195 will become aligned with hole 197 and engage or lock into hole 197. Therefore, rear leg 106 can be easily locked into its proper deployed position, yet is easily unlocked by simply depressing spring button 195. Although illustrated with a Valco button, any suitable latching or locking mechanism can be used.

The Soft Goods

Referring now to FIGS. 1–9 and 15–21, soft goods 200 in accordance with the invention will be discussed in detail. Soft goods 200 generally include a bassinet shell 202, a canopy 212, and a removable pad 216.

Referring to FIGS. 1–9, bassinet shell 202 is constructed such that, in deployed configuration 11, it is suspended from frame 100 and naturally falls into deployed bassinet configuration 12 due to its own weight and gravity as shown in FIG. 1, for example. Thus, bassinet shell 202 is preferably formed of pliable and/or foldable construction such that bassinet shell 202 is conveniently collapsed and folded into deployed bassinet configuration 12. Bassinet shell 202 is constructed such that infant recline/seat feature 222 can be incorporated into soft goods 200 and operated independently of frame 100, as discussed in more detail later. By minimizing the connections between frame 100 and soft goods 200, bassinet shell 202 can be folded-up into compact folded configuration 14 without having to disassemble or disconnect any parts, which is time consuming and inconvenient.

Bassinet shell 202 generally includes a front end 203, a back end 201, a bottom wall 204, an annular side wall 206, and structure to suspend bassinet shell 202 from frame 100 which may include a front tunnel 208 formed on upper annular edge 220 of annular side wall 206 at front end 203 of bassinet shell 202, and a back tunnel 210 formed on upper annular edge 220 of annular side wall 206 at back end 201 of bassinet shell 202.

Figure 9:
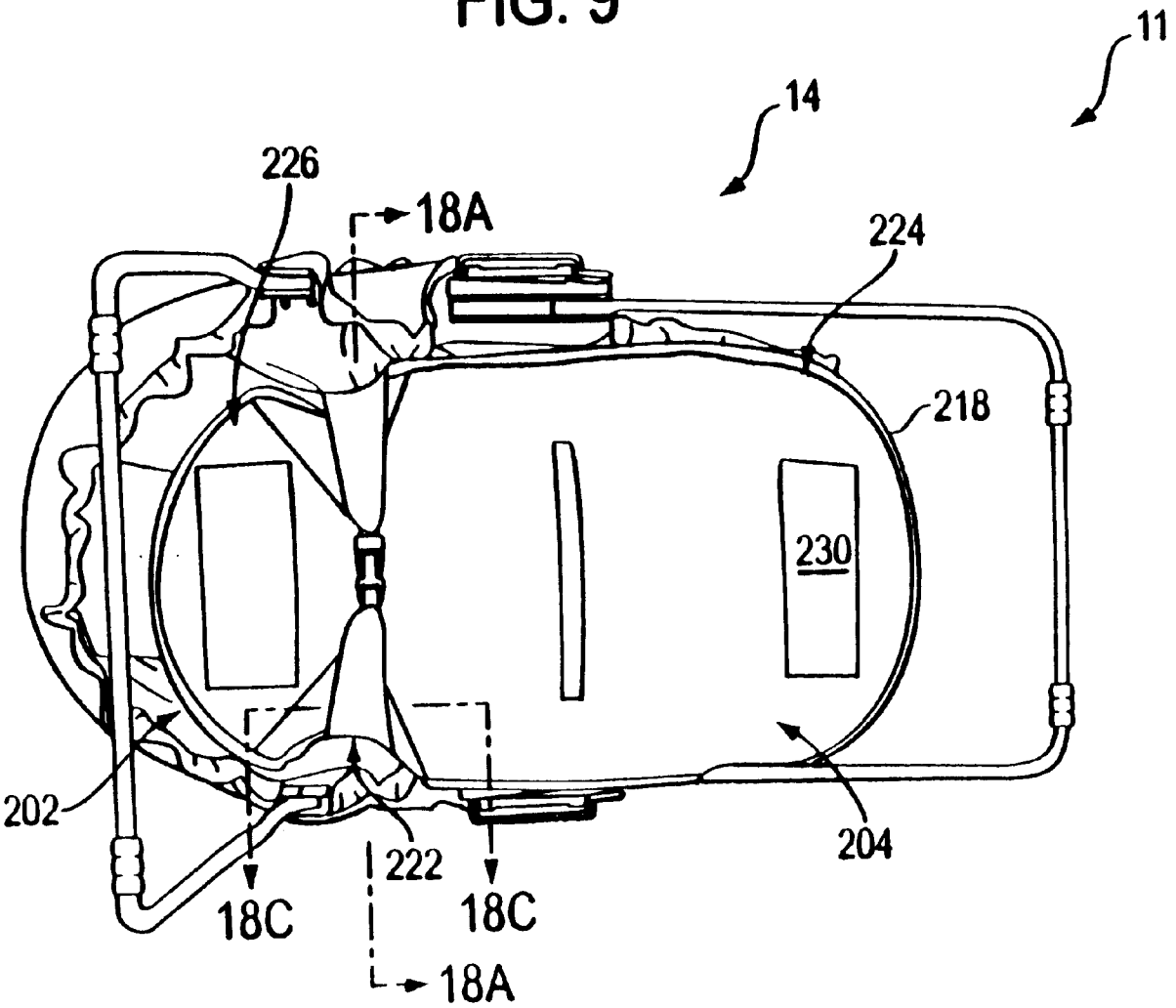
Figure 15:
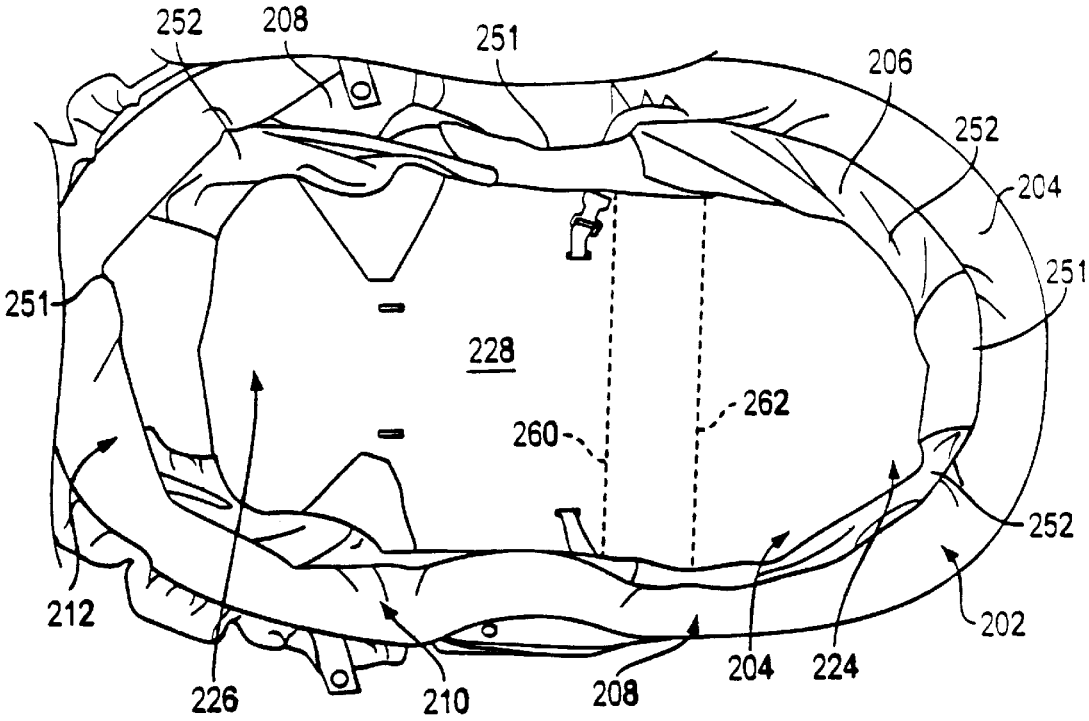
FIG. 15 is a top view of the infant product in accordance with the invention where the removable pad has been removed.
Figure 16:
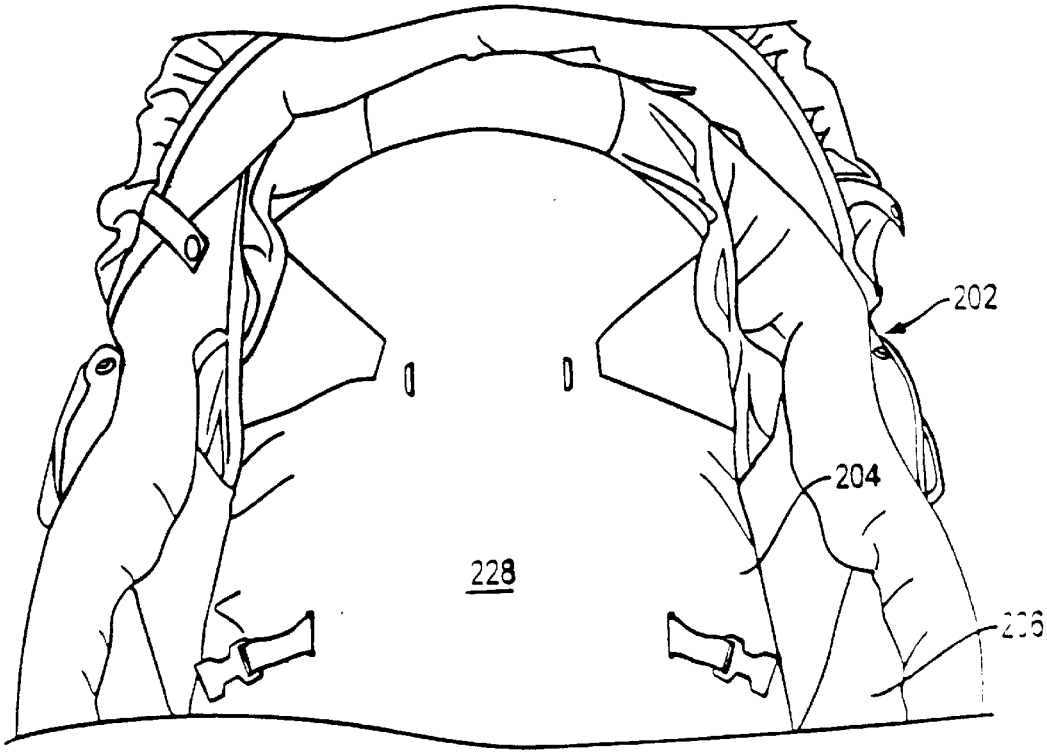
FIG. 16 is a partial top view of the infant product shown in FIG. 15.

Referring to FIGS. 9, 15 and 16, bottom wall 204 of bassinet shell 202 has a generally elliptical shape with an outer perimeter 218, a front end 224, a back end 226, a top surface 228 and a bottom surface 230. Top surface 228 of bottom wall 240 as illustrated in FIGS. 15 and 16, is shown with removable pad 216 removed. As discussed later, removable pad 216 is disposed on top surface 228 of bottom wall 240.

Bottom wall 204 has a jointed rigid construction whereby a substantially rigid flat surface can be maintained in deployed bassinet configuration 12 (FIGS. 1–4), however, which also can be repositioned into deployed infant seat configuration 14 (FIGS. 5–9).

Figure 16A:
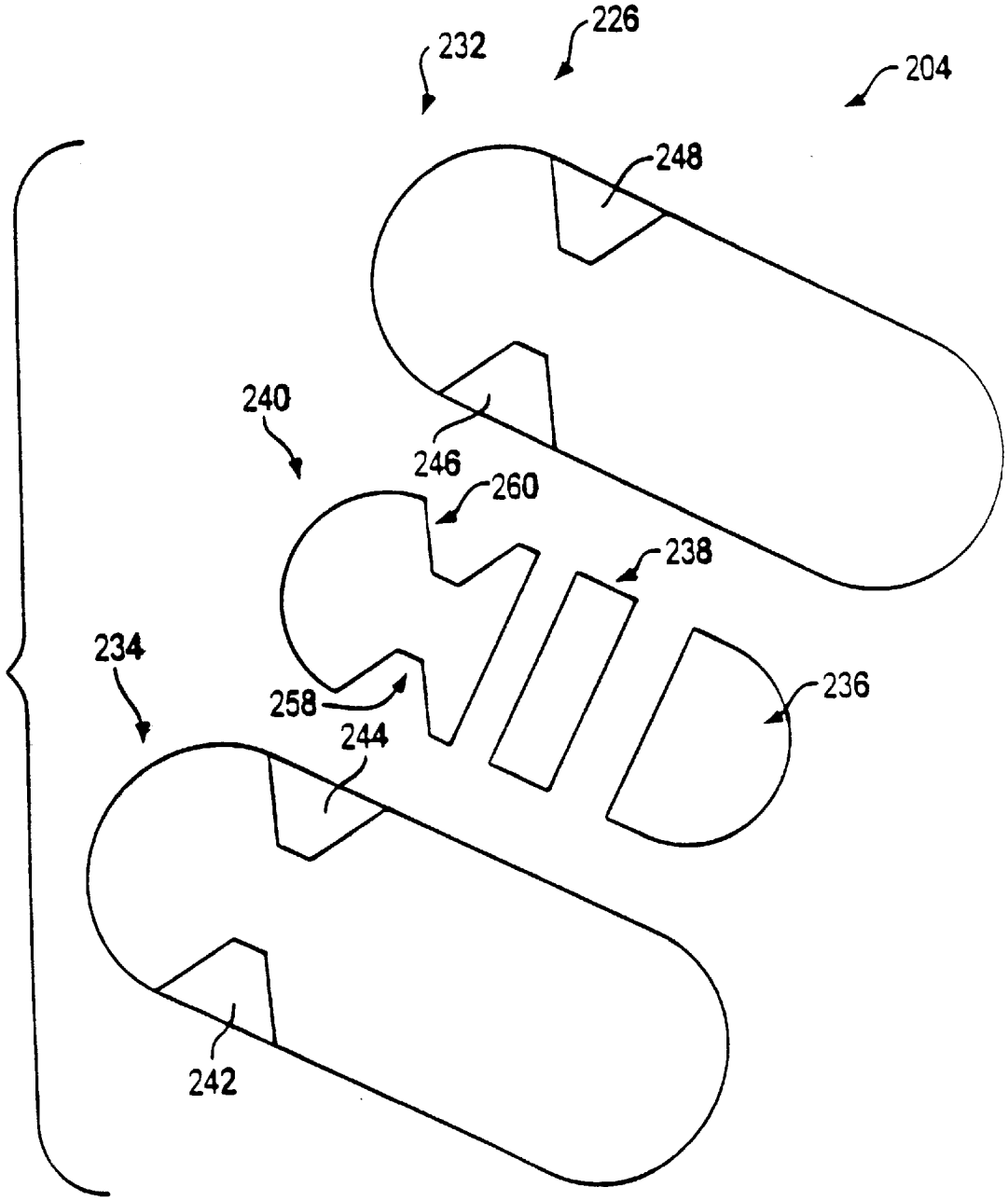
FIG. 16A is an exploded view of the bottom wall of the infant product in accordance with the invention.

In particular, with reference to FIG. 16A, bottom wall 204 is a multi-layer construction including flexible upper cover 232, flexible lower cover 234 and front, intermediate, and back rigid panels 236, 238, 240 interposed between upper cover 232 and lower cover 234. This rigid panel construction also has the advantage of providing a minimal weight bias (relative to lightweight annular side wall 206) in bottom wall 204 which will help bassinet shell 202 naturally fall into deployed bassinet configuration 12 and provide a slight tension on annular side wall 206. Of course, this tension on annular side wall 206 is increased when the infant is placed in bassinet shell 202.

Upper cover 232 is preferably made of an easily cleanable material such as vinyl. It includes a pair of laterally disposed V-shaped notches 246, 248 of elastic material at back end 226. Lower cover 232 is made of a generally non-elastic cloth material and also has a pair of laterally disposed V-shaped notches 242, 244 of elastic material at back end 226. Notches 242, 244, 246, 248 are provided for purposes of infant recline/seat feature 222, discussed in more detail below.

Front, intermediate, and back rigid panels 236, 238, 240 are flat, thin, rigid panels made of any type of rigid relatively lightweight material, such as, hardboard. Front rigid panel 236 is semi-circular in shape, intermediate rigid panel 238 is rectangular in shape and back rigid panel 240 is a partial elliptical shape with laterally disposed V-shaped notches 258, 260. Front, intermediate, and back rigid panels 236, 238 and 240 are disposed in spaced relationship such that they may be rotated and folded unencumbered. Also, seams 260, 262 (FIG. 15) may be provided to separate rigid panels 236, 238, 240 to prevent displacement of rigid panels 236, 238, 240. For example, back panel 240 in back end 226 of bottom wall 204 can be pivoted from deployed bassinet configuration 12 substantially parallel to transverse axis T, to deployed infant seat configuration, which is angled relative to transverse axis T, for example, 30–35° from transverse axis T. Back rigid panel 240 is held in deployed infant seat configuration 14 by infant recline/seat feature 222, as discussed in more detail below.

Annular sidewall 206 is attached to outer perimeter 218 of bottom wall 204 by, for example, stitching. Annular sidewall 206 forms a lateral restraint for the infant in addition to contributing to suspending bottom wall 204. Annular sidewall 206 is formed of soft flexible material and may include a patchwork of solid cotton fabric panels 251 and breathable mesh fabric 252. However, any type of material that will not scratch or injure an infant may be used. Panels 251 may be formed of a solid cotton fabric for durability. As discussed later, annular sidewall 206 can be folded and formed into compact folded configuration 16, yet serves as a semi-rigid wall for providing lateral support when under tension in deployed configuration 11.

Figure 4:
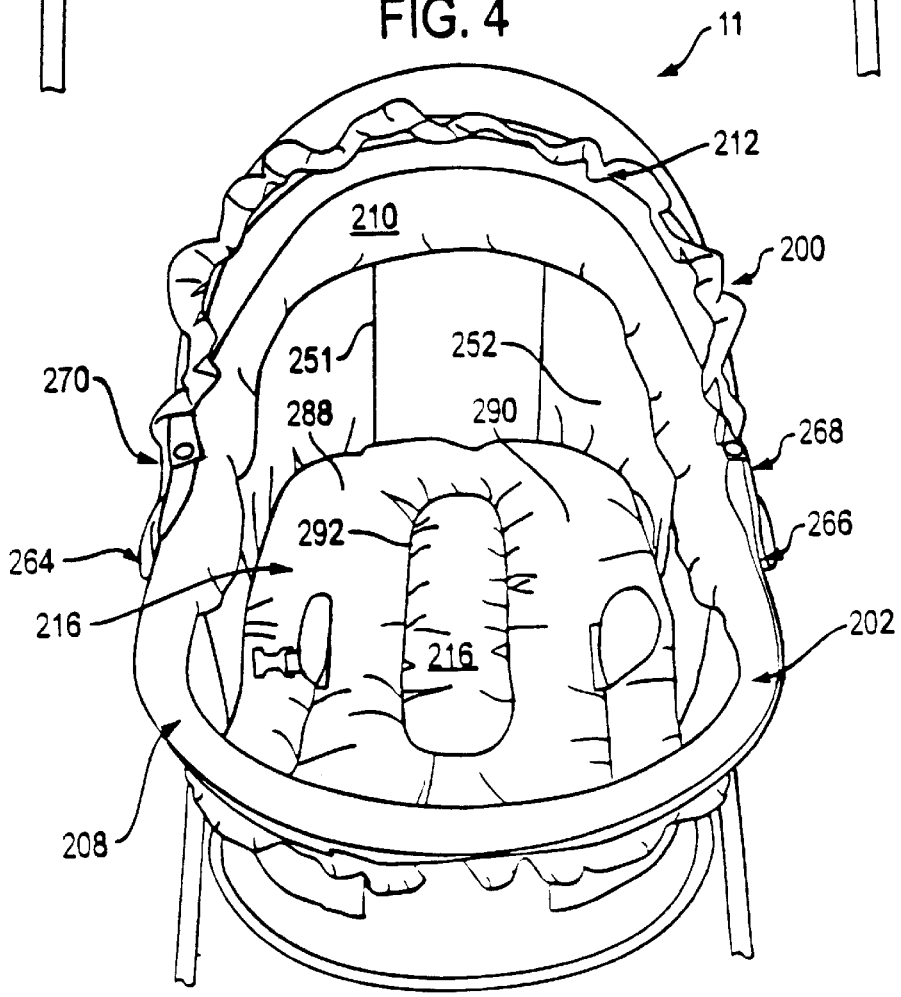
Figure 5:
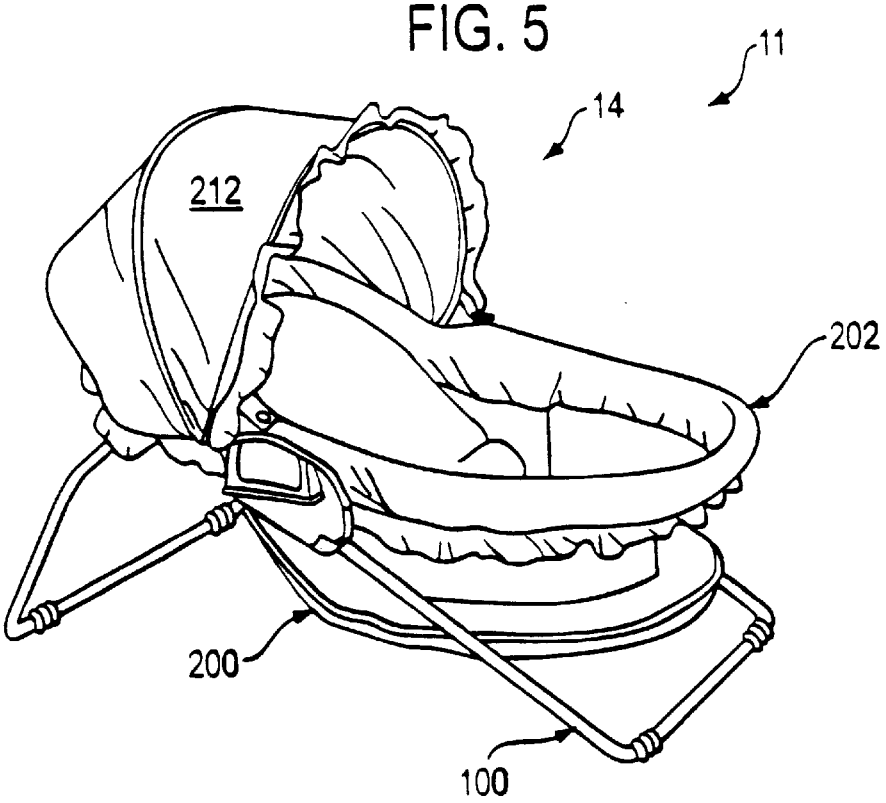
FIGS. 5–9 are a perspective, side, back end, top and bottom views, respectively, of the infant product in accordance with the invention in the infant seat position.
Figure 6:
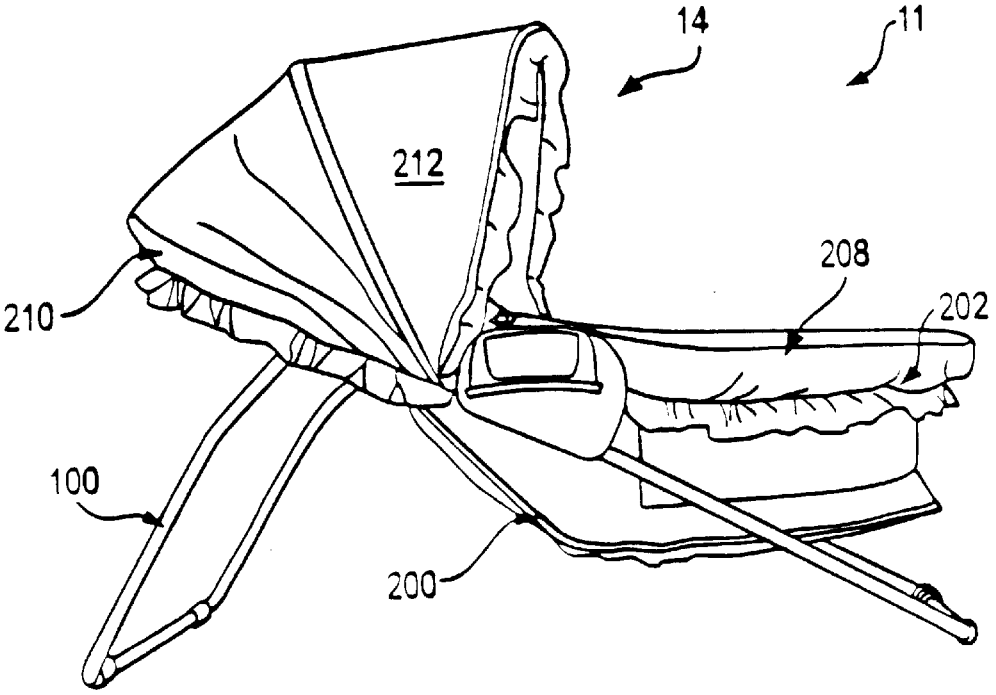
Figure 7:
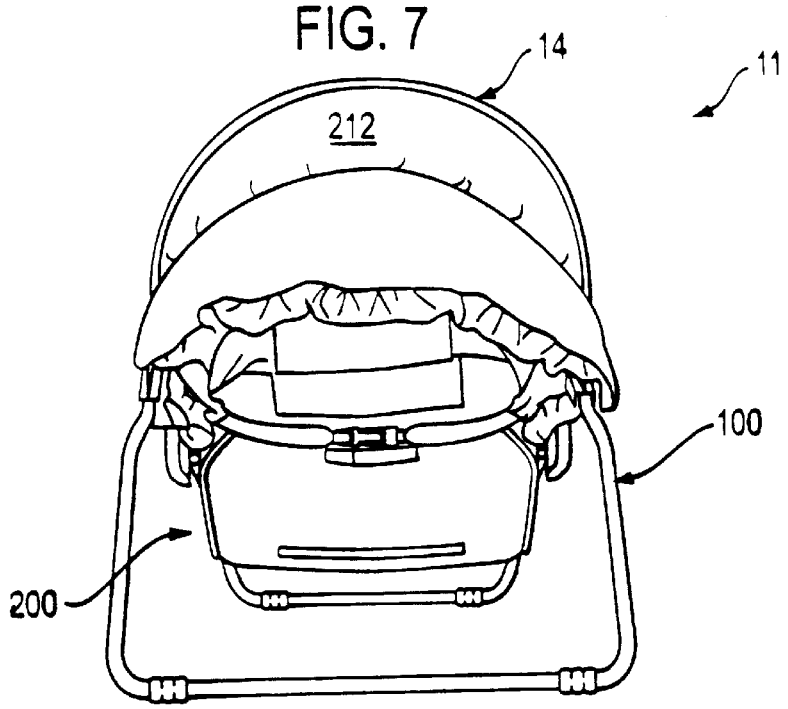
Figure 8:
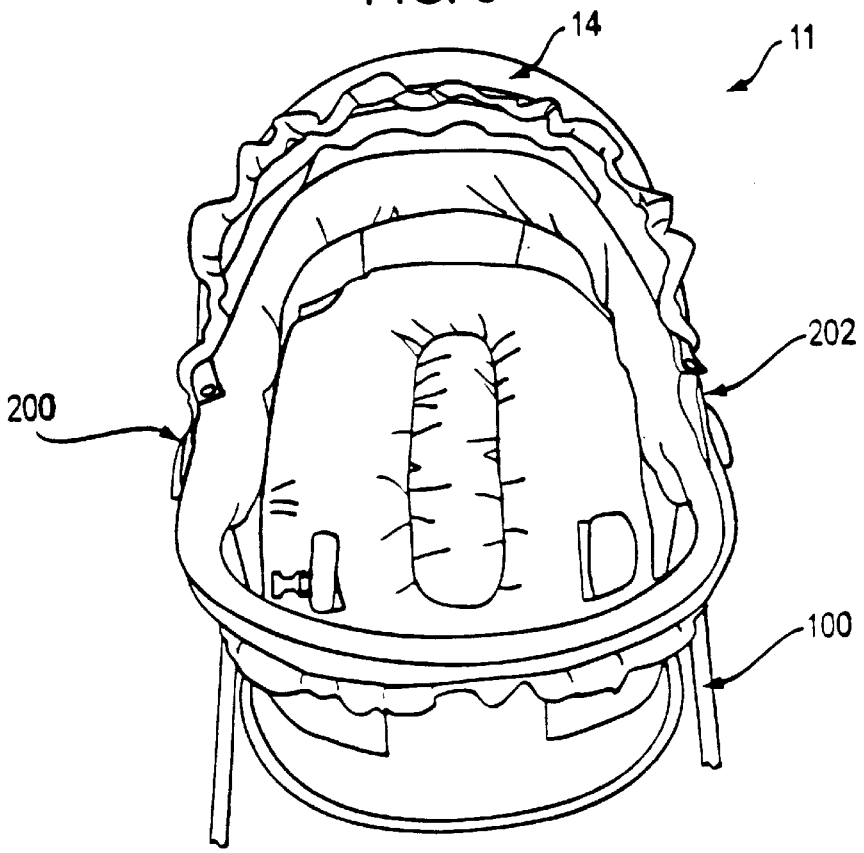

Front and back tunnels 208, 210 (FIG. 1) are formed to suspend bassinet shell 202 from annular upper rim frame 102. Front and back tunnels 208, 210 may be sewn onto upper annular edge 220 of annular side wall 206 or may be an extension of annular side wall 206. Front and back tunnels 208, 210 may be formed of a soft material padded with batting to cushion around front rim tube 116 and back rim tube 122. Front and back tunnels 208, 210 are constructed to form a front passageway in front tunnel 208 having open ends 264, 266 and a back passageway in back tunnel 210 having open ends 268, 270 (FIG. 4). Accordingly, front rim tube 116 is threaded through the front passageway in front tunnel 208 and back rim tube 122 is threaded through the back passageway in back tunnel 210.

Removable pad 216 is disposed on top surface 228 of bottom wall 204 of bassinet shell 202 and may include any conventional pad having a substantially elliptical shape corresponding to the shape of bassinet shell 202. Removable pad 216 may be made of a cloth material having a batting filling. Crease 292 (FIG. 4) may be formed in removable pad 216, for example, using a seam to provide flexibility for lateral edges 288, 290 as discussed below with reference to FIG. 18A.

A known nylon webbing three-point restraint may be incorporated into bassinet shell 202 to support the infant in deployed infant seat configuration 14.

Although a particular embodiment of bassinet shell 202 has been described above, other configurations and materials may be used so long as, for example, the bassinet shell is suspended from the frame in a manner appropriate to support the infant in either of the bassinet and infant seat configurations and the bassinet shell is easily folded into compact folded configuration 16 along with frame 100.

Figure 17:
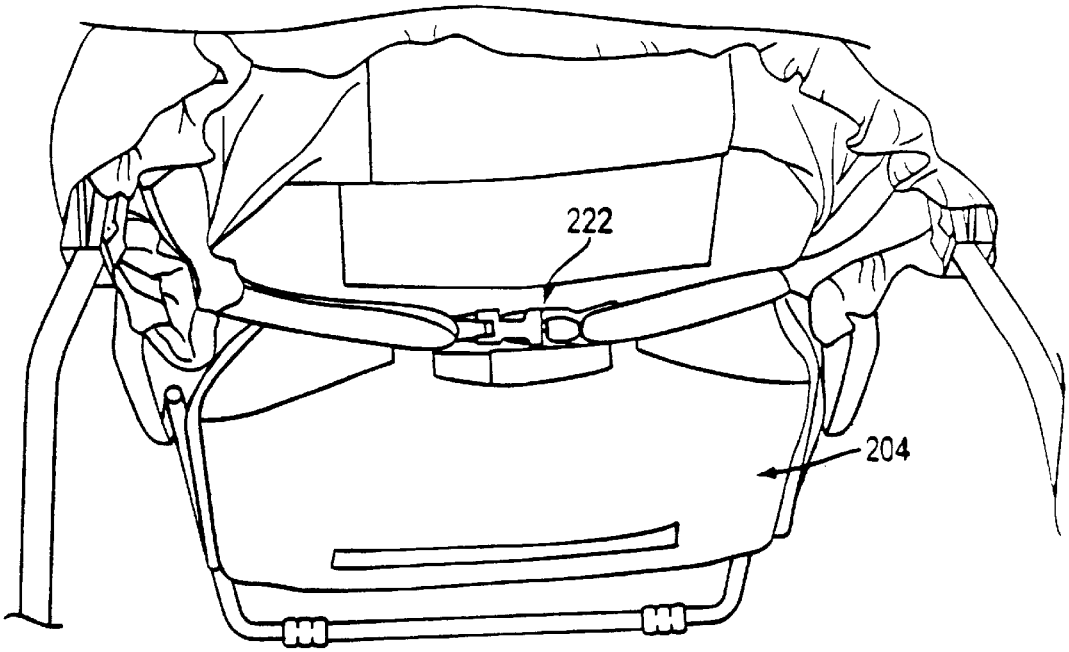
FIG. 17 is a back end view of the infant product in accordance with the invention showing the support strap system for the infant recline/seat feature.
Figure 18:
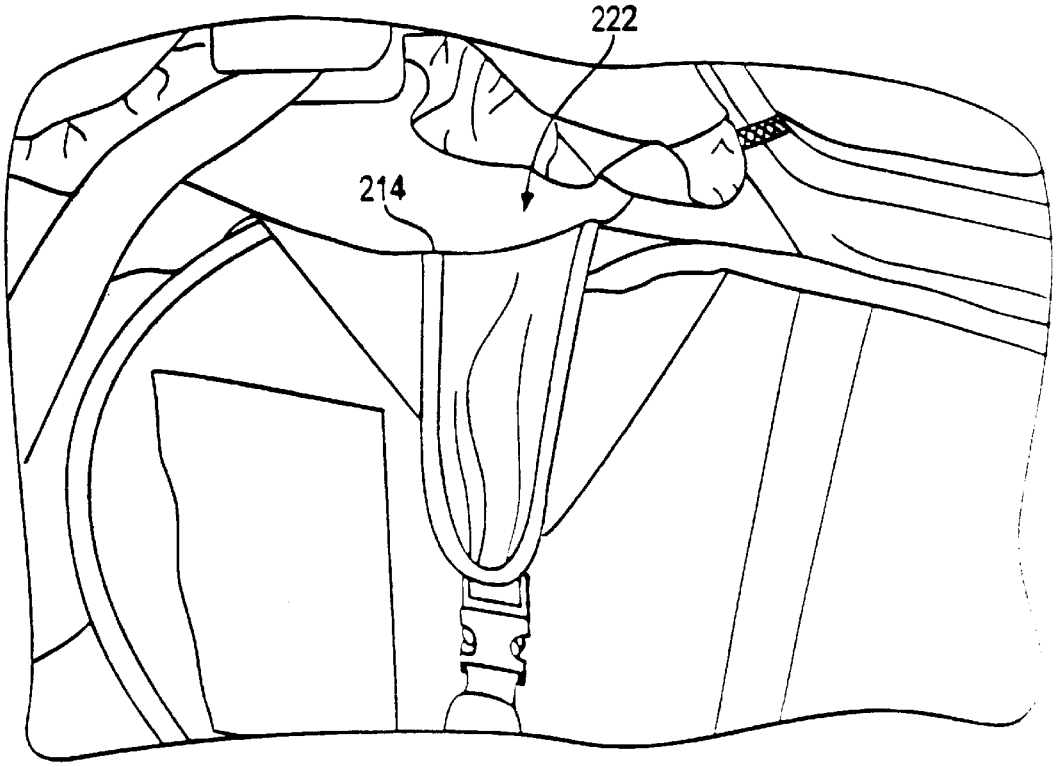
FIG. 18 is a partial view of the support strap system shown in FIG. 17.
Figure 18A:
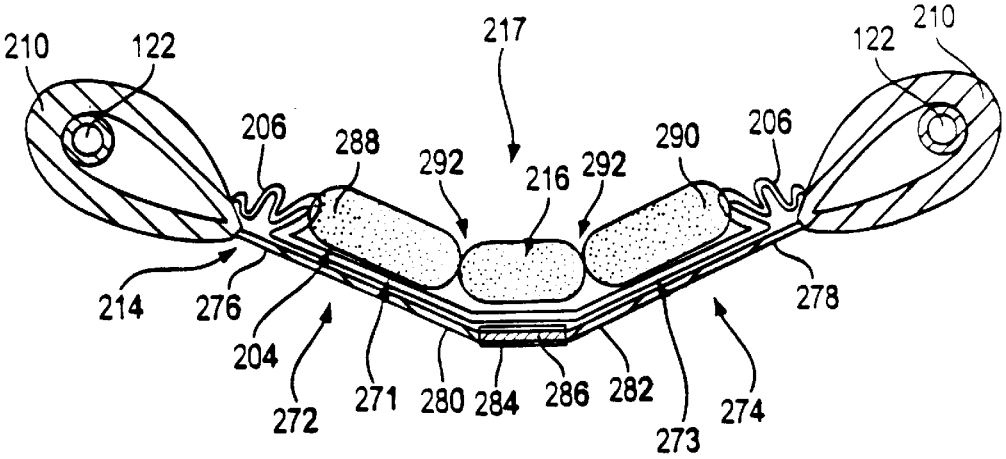
FIG. 18A is a cross-sectional view taken along line 18A—18A in FIG. 9.
Figure 18B:
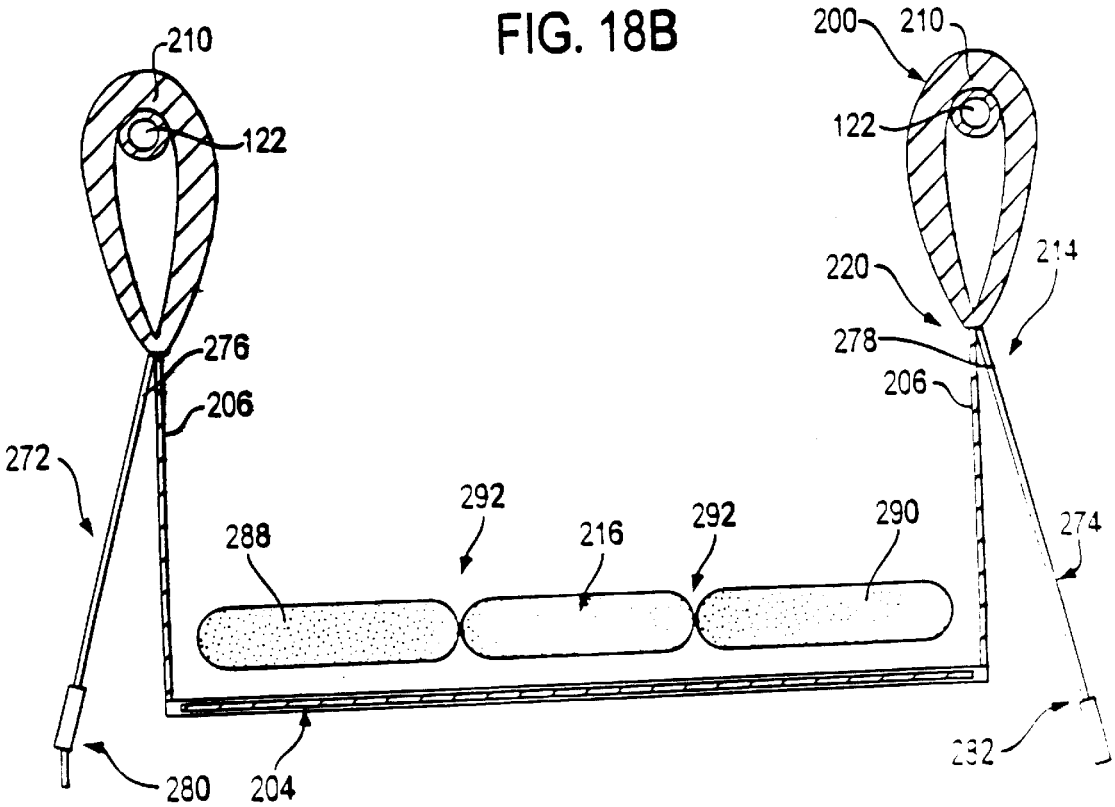
FIG. 18B is a cross-sectional view taken along line 18B—18B in FIG. 1.
Figure 18C:
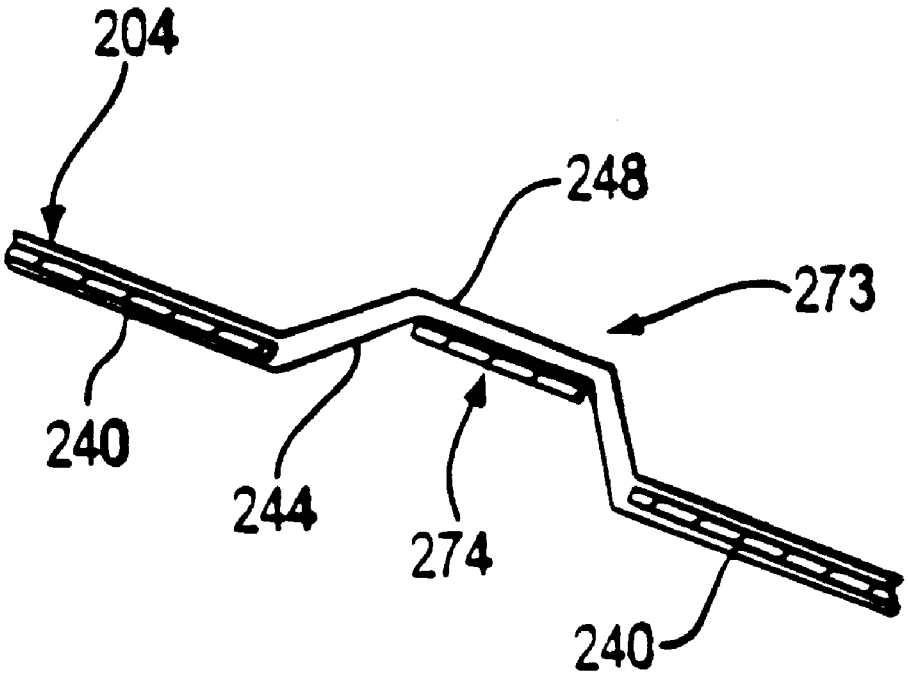
FIG. 18C is a partial cross-sectional view taking along line 18C—18C in FIG. 9.
Figure 19:
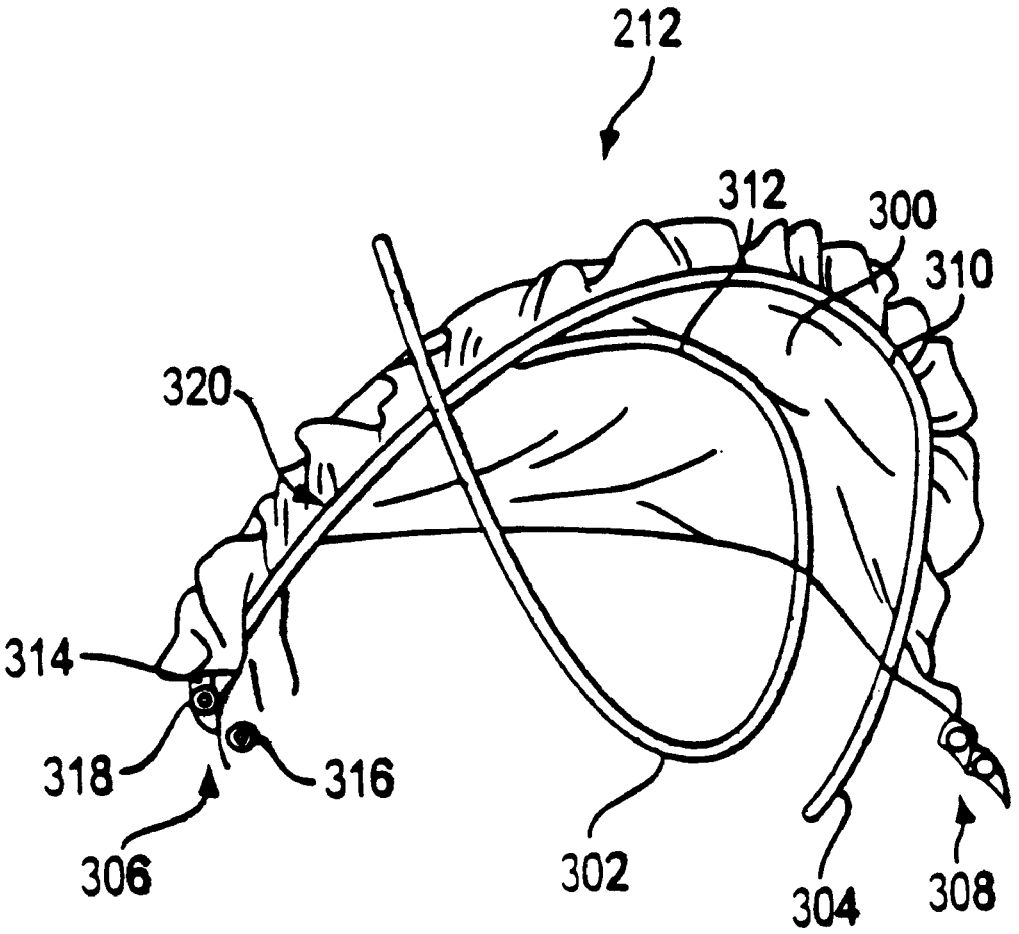
FIG. 19 is a perspective view of the canopy in accordance with the invention.

Referring now to FIGS. 17–19, infant recline/seat feature 222 will now be described. In particular, FIG. 17, 18 and 18A illustrate back end 226 of bottom wall 204 in deployed infant seat configuration 14, whereas FIG. 1 and FIG. 18B illustrate the deployed bassinet configuration 12. Infant recline/seat feature 222 includes a support strap assembly 214 of the type described for use with a stroller in U.S. Pat. No. 5,590,896 issued Jan. 7, 1997 to the same assignee as the instant application and the disclosure of which is incorporated herein by reference. Support strap assembly 214 includes straps 272, 274. Each strap 272, 274 includes an end 276, 278, respectively, attached to upper annular edge 220 of annular side wall 206 by a seam, for example. In addition, each strap 272, 274 has an end 280, 282 to which a connector is attached. The connector may include any conventional easy connect connector such as a buckle as shown.

When straps 272, 274 are connected to each other, they form a support raised above where bottom wall 204 of bassinet shell 202 would otherwise rest as illustrated by the comparison of FIGS. 18A and 18B, for example. In use, back end 201 of bottom wall 204 is raised to an angled position and straps 272, 274 are interconnected to support back end 201 of bottom wall 204 in deployed infant seat configuration 14. As illustrated in FIG. 1 and FIG. 18B, when straps 272, 274 are not in use, they simply hang along side annular side wall 206 of bassinet shell 202. Once straps 272, 274 have been disconnected, the back end of bassinet shell 202 naturally returns to bassinet configuration 12 due to its own weight and gravity.

It is within the scope of the invention to raise and/or tilt bottom wall 204 of bassinet shell 202 in any manner desirable. For example, the front end of bassinet shell 202 may also include a strap and buckle connector that when joined will support front end 224 of bottom wall 204 of bassinet shell 202 in a raised position to provide an alternate seating position for the infant. A variety of known seat back recline mechanisms which could be adapted for use with the disclosed bassinet shell in ways apparent to the artisan.

Furthermore, in accordance with the invention and as also illustrated in FIGS. 15, 16, 16A, 17, 18A and 18C, the infant product may also be constructed to provide additional lateral support at the back end of bassinet shell 202 to cradle the upper end of the infant in the deployed infant seat configuration 14. This may be accomplished, for example, through the use of straps 272, 274, just described, in combination with the V-shaped notches 242, 244, 246, 248 of elastic material formed in lower cover 234 and upper cover 232, respectively, and V-shaped notches 258, 260 in rigid panel 240 of bottom wall 204. Accordingly, straps 272, 274 can compress against and into bottom wall 204 to create lateral protuberances 271, 273 (FIGS. 18A, 18C) extending upwardly from otherwise planar back end 226 of bottom wall 204. With protuberances 271, 273, the portion of bottom wall 204 corresponding to the upper body and head of an infant forms a V-shape or cradle (FIG. 18A). When removable pad 216 is positioned on bottom wall 204, removable pad 216 conforms to the shape of bottom wall 204, thereby also forming a cradle shown generally at 217 in FIG. 18A. Crease 292 facilitates the displacement of lateral edges 288, 290 of removable pad 216. As illustrated in FIG. 18B, when straps 272, 274 are not connected, removable pad 216 is substantially flat.

This cradle feature may be implemented in variety of ways and is not limited to the structure described herein. For example, the back end 226 of bottom wall 204 may include a three-way fold, which may be implemented using a three-piece rigid back panel 240. Another way to provide lateral support for an infant, which also may be used in accordance with the invention, is described in the context of a stroller in U.S. Pat. No. 5,441,328 issued Aug. 15, 1995, which has the same assignee as the instant invention and the disclosure of which is incorporated herein by reference.

Referring now to FIGS. 1 and 19–21 canopy 212 will be discussed in detail. Canopy 212 is attached to the back end of bassinet shell 202 and is convertible between an open tensioned position as shown, for example, in FIG. 1 and a closed relaxed position shown, for example, in FIG. 21.

Canopy 212 generally includes fabric panel 300, ribs or stays 302, 304 and connectors 306, 308. Fabric panel 300 can be made of any lightweight material or cloth that is generally inelastic. Sewn into fabric panel 300 are sleeves 310, 312 in spaced relationship into which stays 302, 304 are threaded as illustrated in FIG. 19. Accordingly, stays 302, 304 are separated from each other. Stays 302, 304 may be made of resilient material such as extruded plastic. Stays 302, 304, when inserted into sleeves 310, 312 in fabric panel 300 hold the arcuate shape of canopy 212. Connector 306 may include any suitable mechanism for releasably coupling front edge 320 of fabric panel 300 to a supporting structure so as to place fabric panel 300 in tension. Suitable connectors include buckles, hook-and-loop fasteners, zippers, magnetic catches, J-hooks, etc.

Figure 19A:
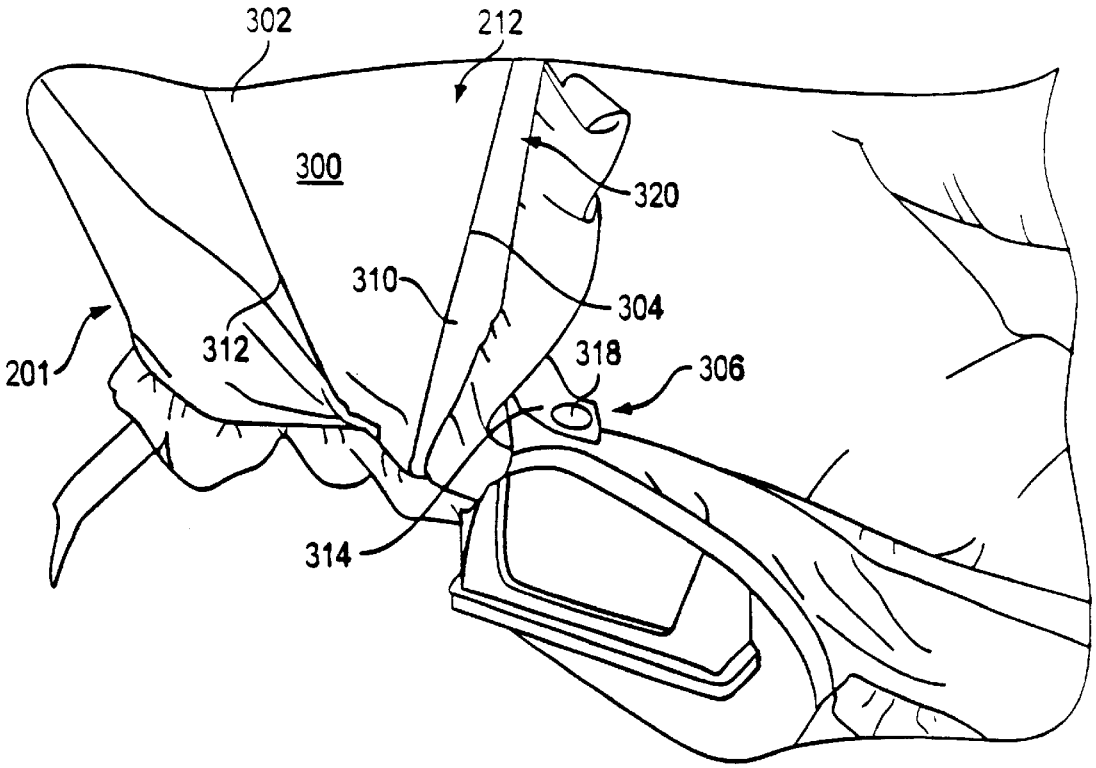
FIG. 19A is a partial view of the canopy in accordance with the invention in the expanded and secured position.
Figure 20:
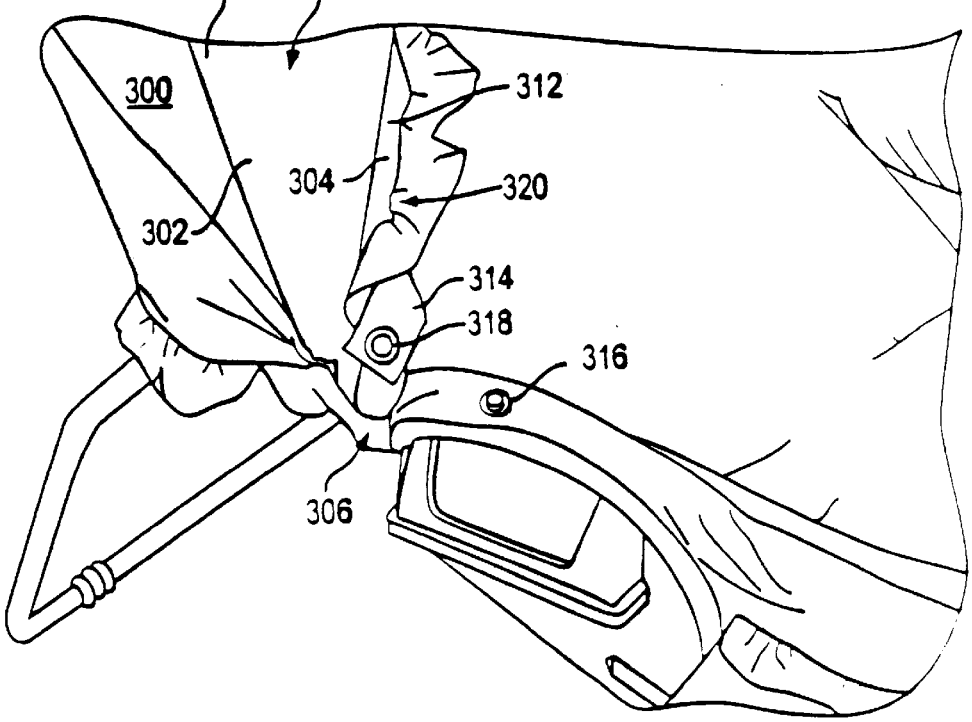
FIG. 20 is a partial view of the canopy in accordance with the invention in the unsecured position.
Figure 21:
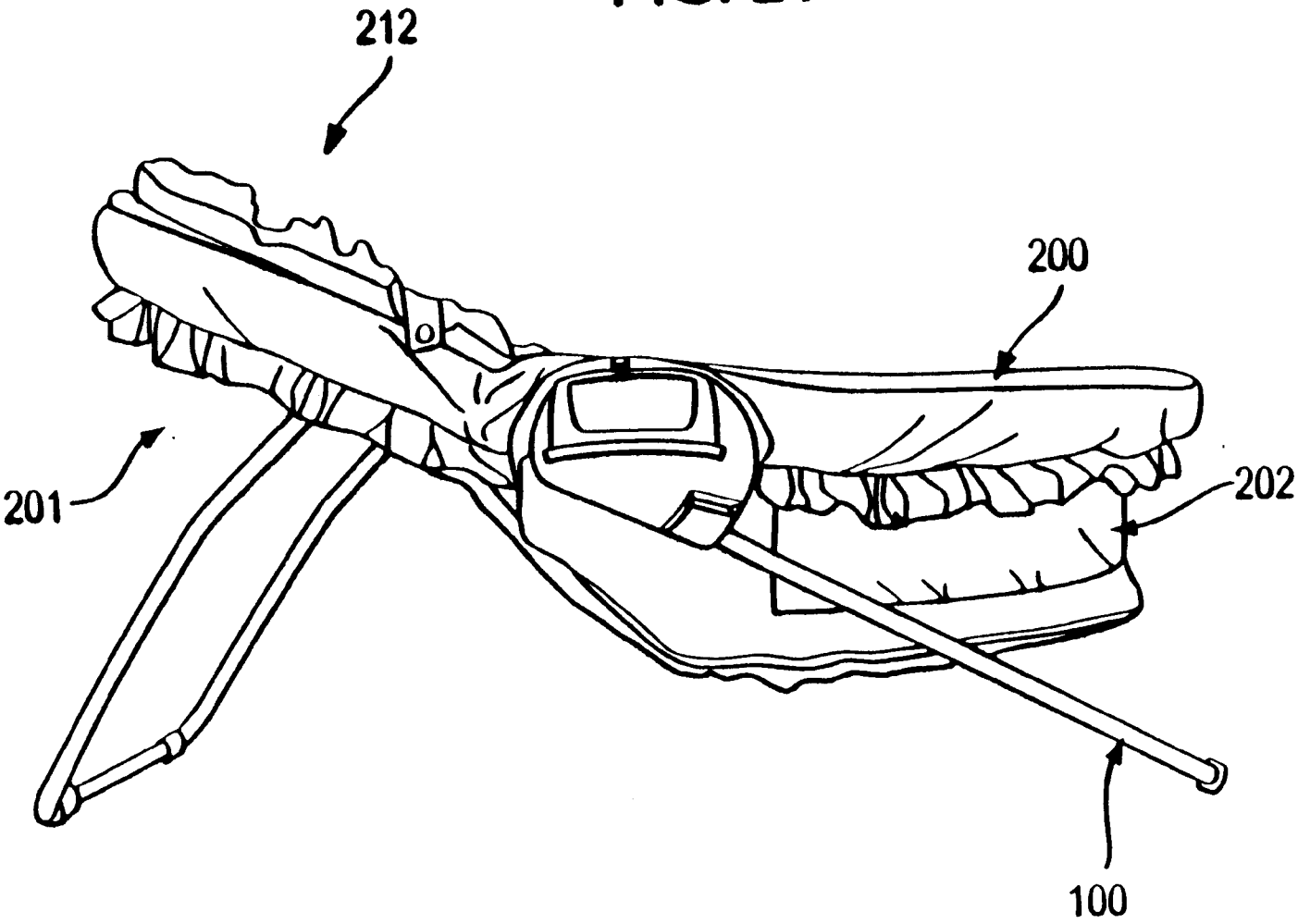
FIG. 21 is a side view of the canopy in accordance with the invention in the closed position.

Canopy 212 is held in the open position by connectors 306, 308 as illustrated in FIGS. 19A and 20. FIG. 19A shows connector 306, for example, in a connected position and FIG. 20 shows connector 306 in a released position. Connectors 306, 308 are identical, accordingly, only connector 306 is described in detail. Connector 306 includes tab 314 of cloth material sewn to front edge 320 of fabric panel 300, a male snap 316 provided on tab 314, and a female snap 318 provided on bassinet shell 202. Accordingly, canopy 212 is held in the open tensioned position by engaging snaps 316, 318. When connectors 306, 308 are released, canopy 212 is foldable into a flat configuration at back end 201 and rests along back rim tube 122 as illustrated in FIG. 21.

Figure 21A:
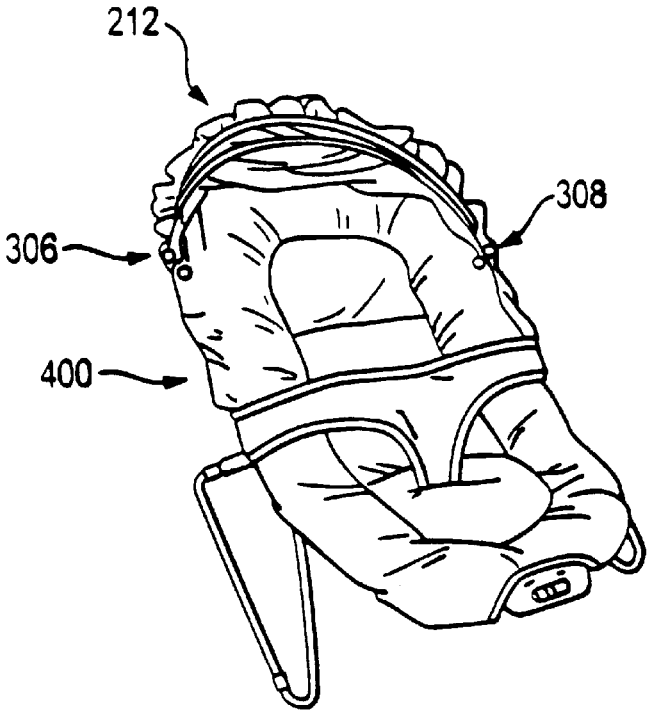
FIGS. 21A–B are front views of an alternate embodiment of an infant product incorporating the canopy in accordance with the invention where the canopy is in the closed and open positions, respectively.
Figure 21B:
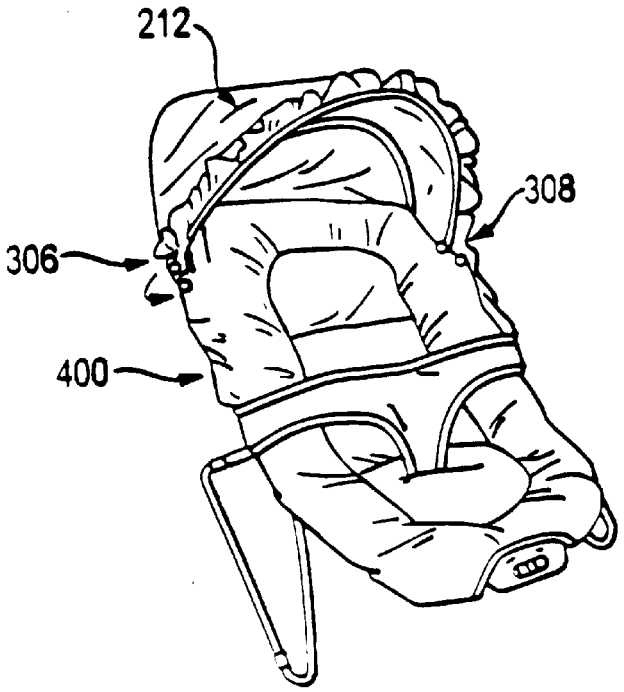
Figure 22:
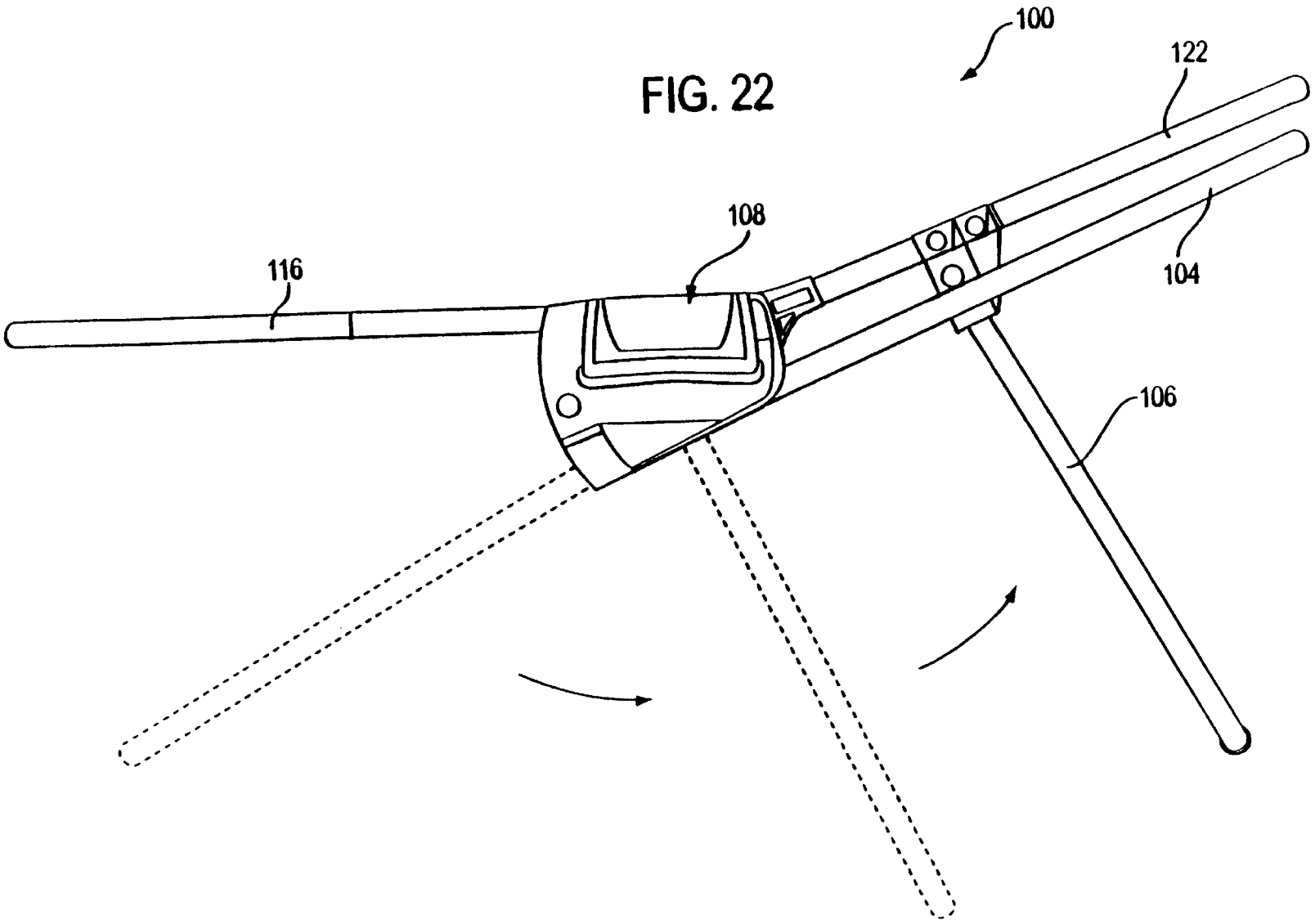
FIG. 22 is a side view of the conversion of the front leg of the frame from the assembled position to the compact position.

Canopy 212 in accordance with the invention may be used on any type of infant product. For example, as illustrated in FIGS. 21A and 21B, canopy 212 may be provided on a conventional bouncer seat 400. FIG. 21A shows canopy 412 in the flat closed position and FIG. 21B shows canopy 412 in the open expanded position. Accordingly, it is within the scope of the invention to use the canopy in a variety of infant products.

The Method of Folding and Unfolding the Infant Product

Referring now to FIGS. 22–25, the manner of converting frame 100 from deployed configuration 11 into compact folded configuration 16 will now be described. Of course, the steps would be performed in reverse to convert from compact folded configuration 16 into deployed configuration 11.

To begin folding deployed configuration 11, it does not matter whether bassinet shell 202 is in deployed bassinet configuration 12 or deployed infant seat configuration 14. The method is a three-step folding process. First, front leg 104 is pivoted as illustrated by directional arrows in FIG. 22 about 180° to its folded position at which point front leg 104 detents against back leg brackets 112, 114.

Figure 23:
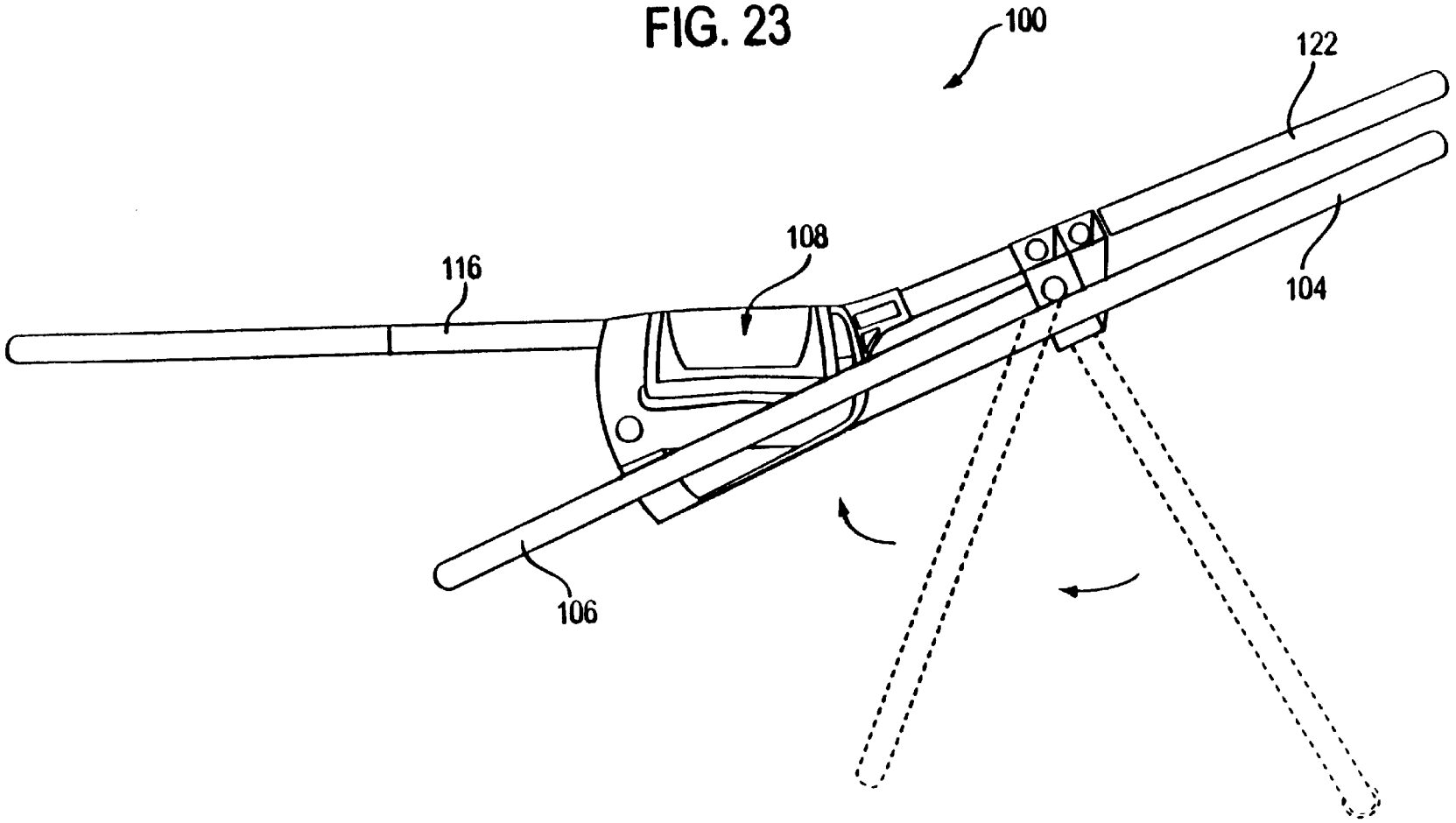
FIG. 23 is a side view of the conversion of the rear leg from the assembled position to the compact position.

Referring now to FIG. 23, secondly, back leg 106 is pivoted about 100° into its folded position at which point side legs 130, 132 detent against the exterior side wall of housings 154, 156 of structural hubs 108, 110.

Figure 24:
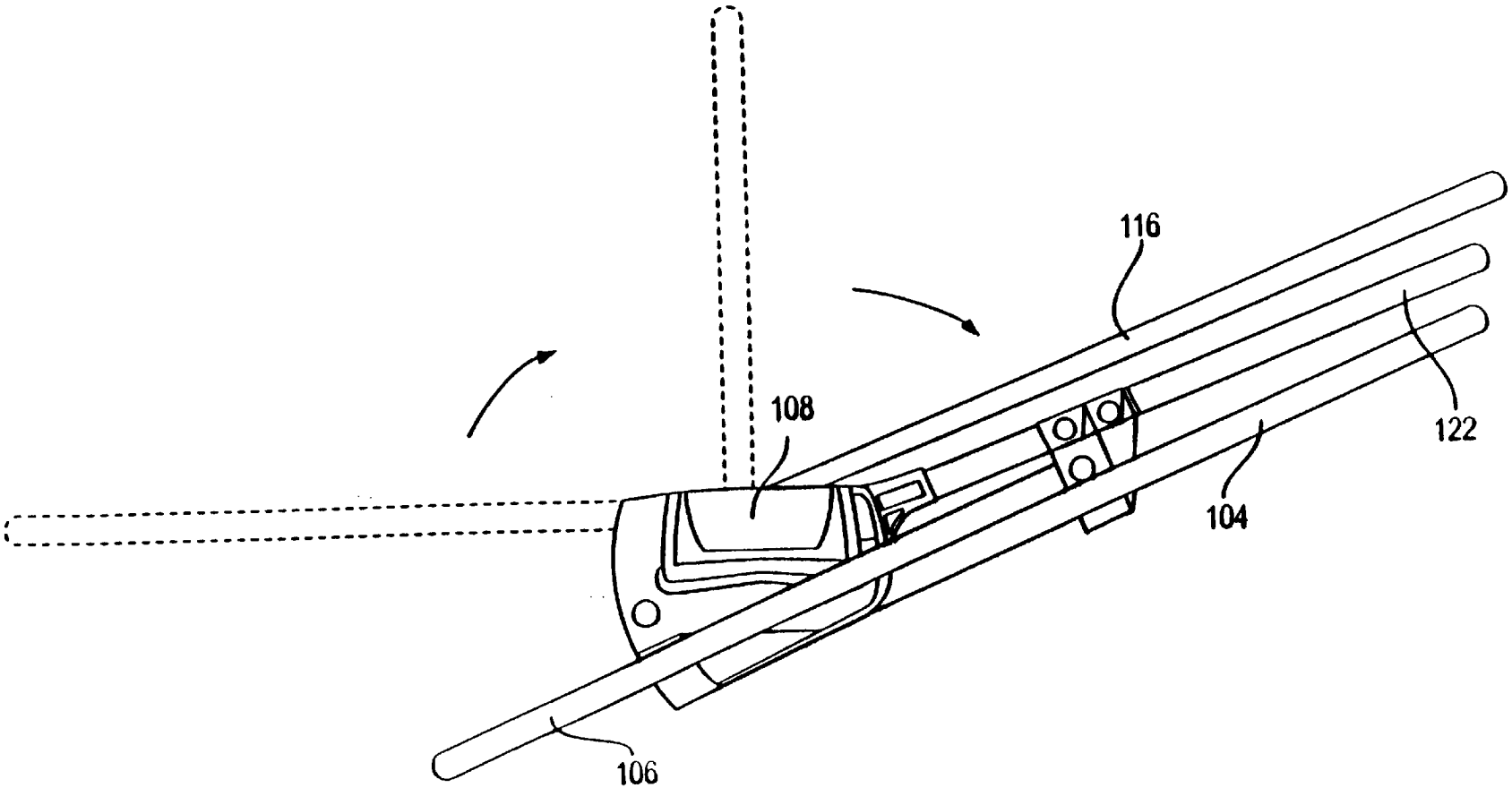
FIG. 24 is a side view of the conversion of the front arcuate member from the assembed position to the compact position such that the frame is in its compact configuration.
Figure 25:
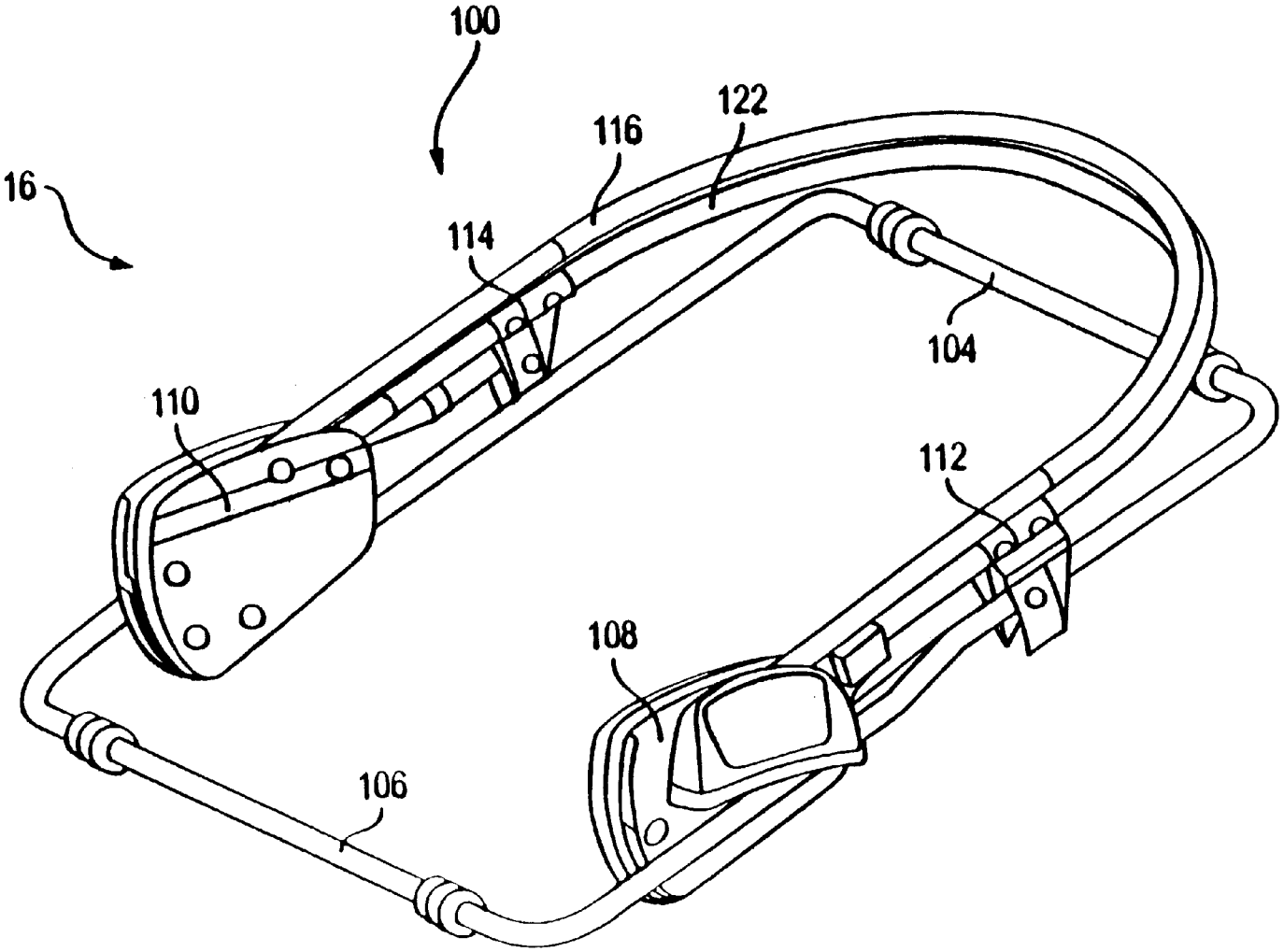
FIG. 25 is a perspective view of the frame in the compact configuration.
Figure 26:
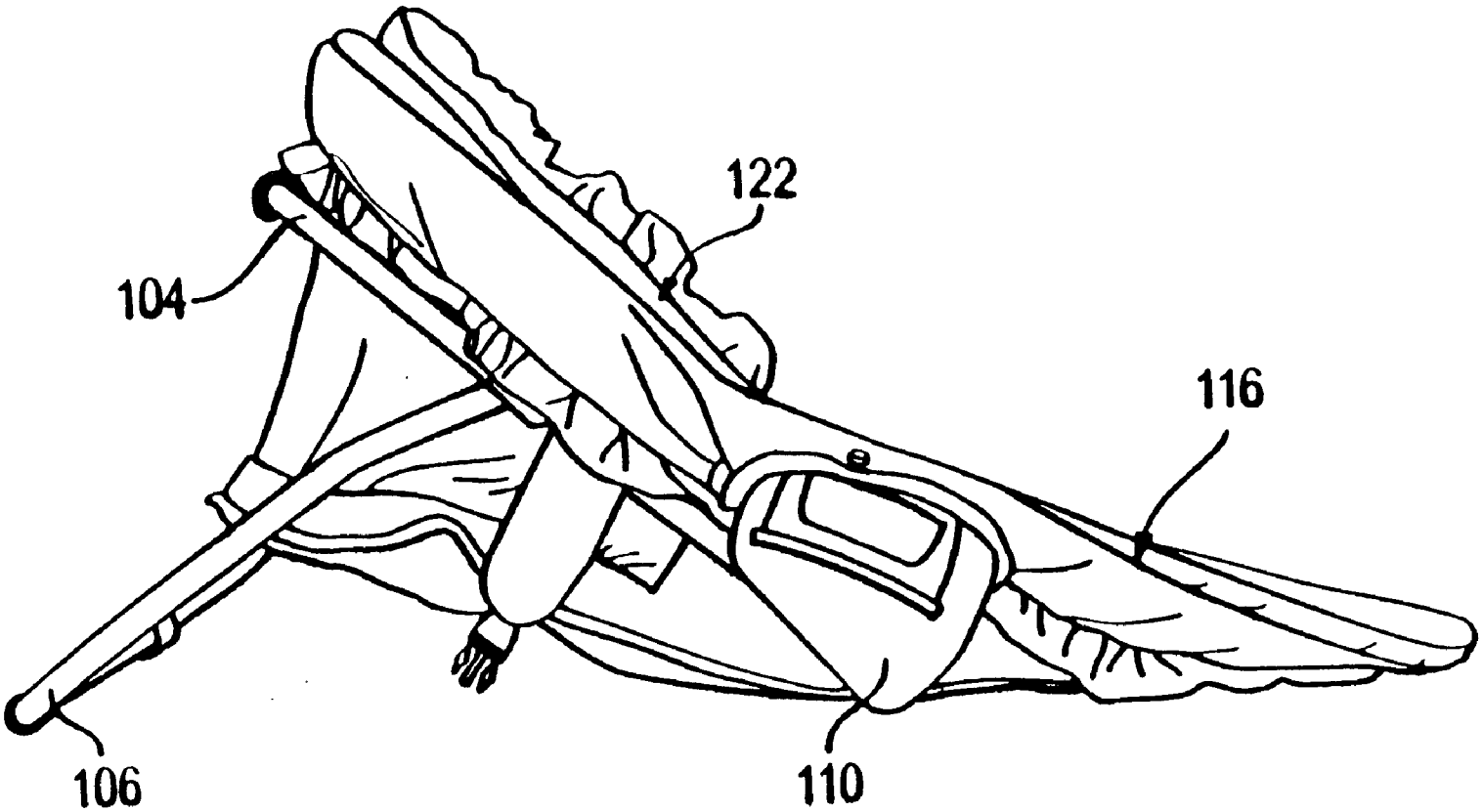
FIG. 26 is a side view of the infant product in accordance with the invention where only the front leg is disposed in the compact configuration.
Figure 27:
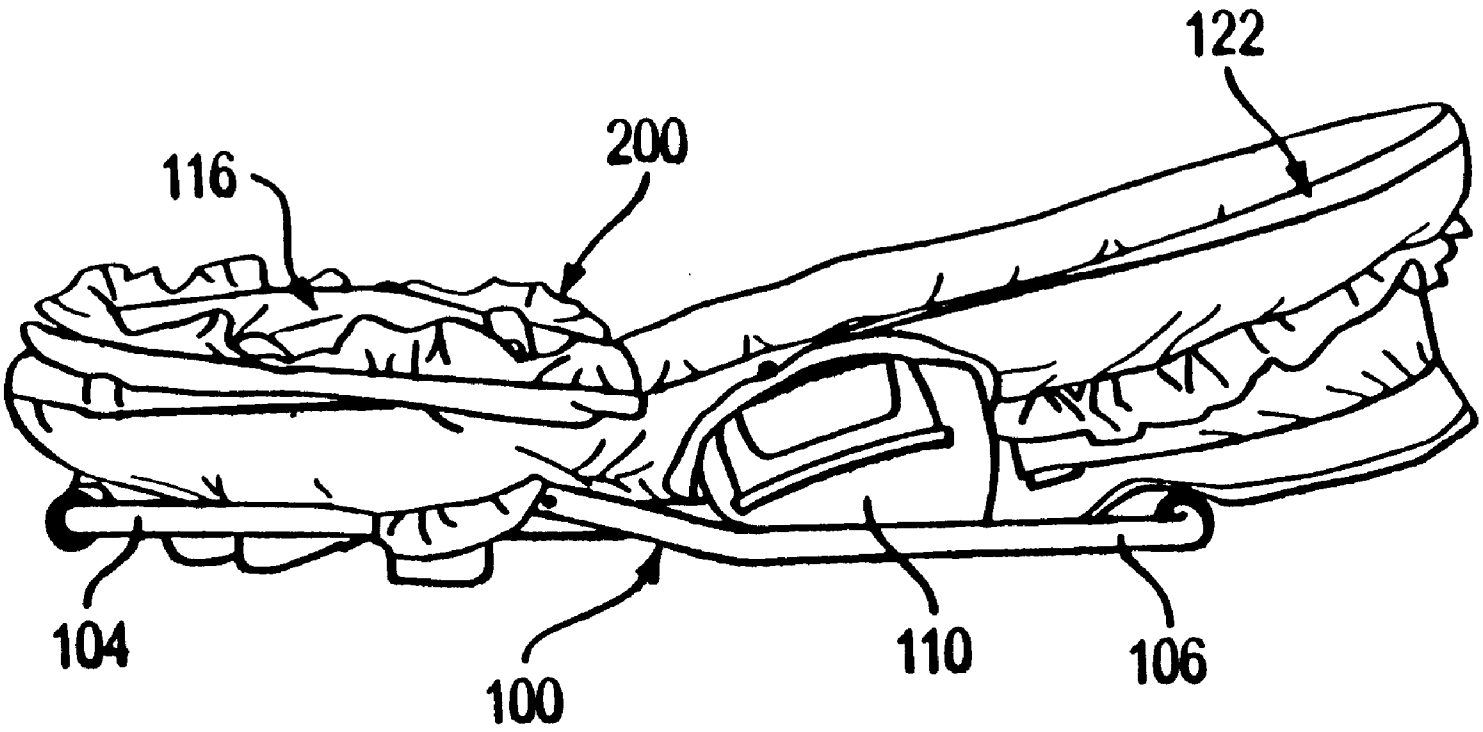
FIG. 27 is a side view of the infant product in accordance with the invention where both the front rear legs are in the compact position.
Figure 28:
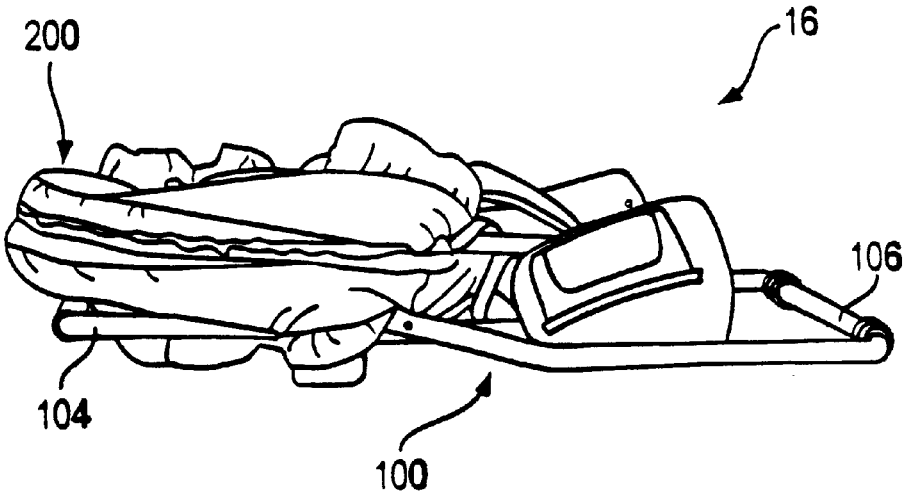
FIGS. 28–30 are side, top and back views, respectively, of the infant product in the compact configuration.
Figure 29:
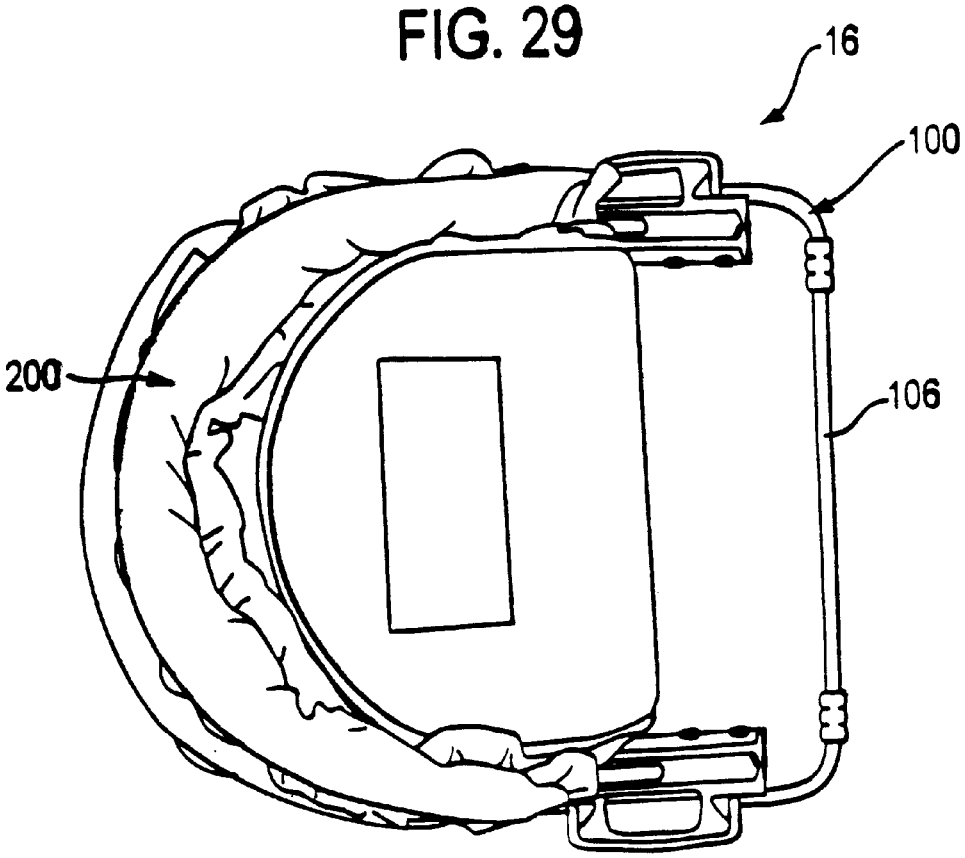
Figure 30:
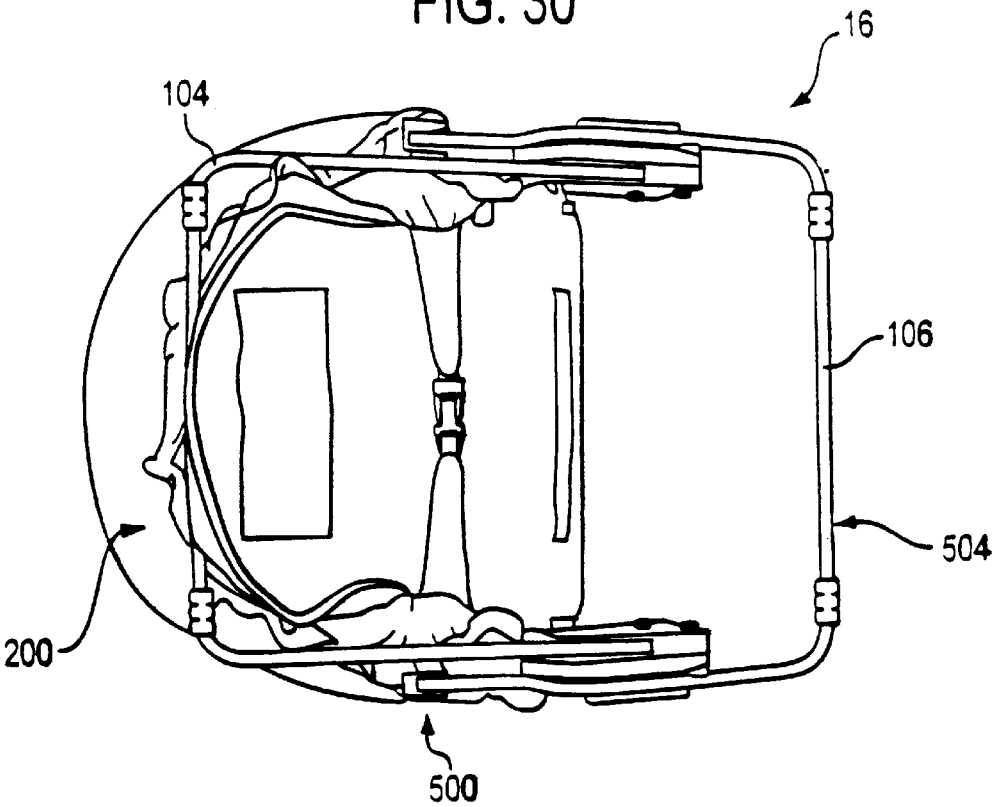

Finally, thirdly, referring to FIGS. 24–25, front rim tube 116 is pivoted about 150° about structural hubs 108, 110 until it is positioned substantially adjacent and rests on back rim tube 122.

FIGS. 26–29 show the same conversion, but with the finished product, i.e., frame 100 and soft goods 200.

Figure 31:
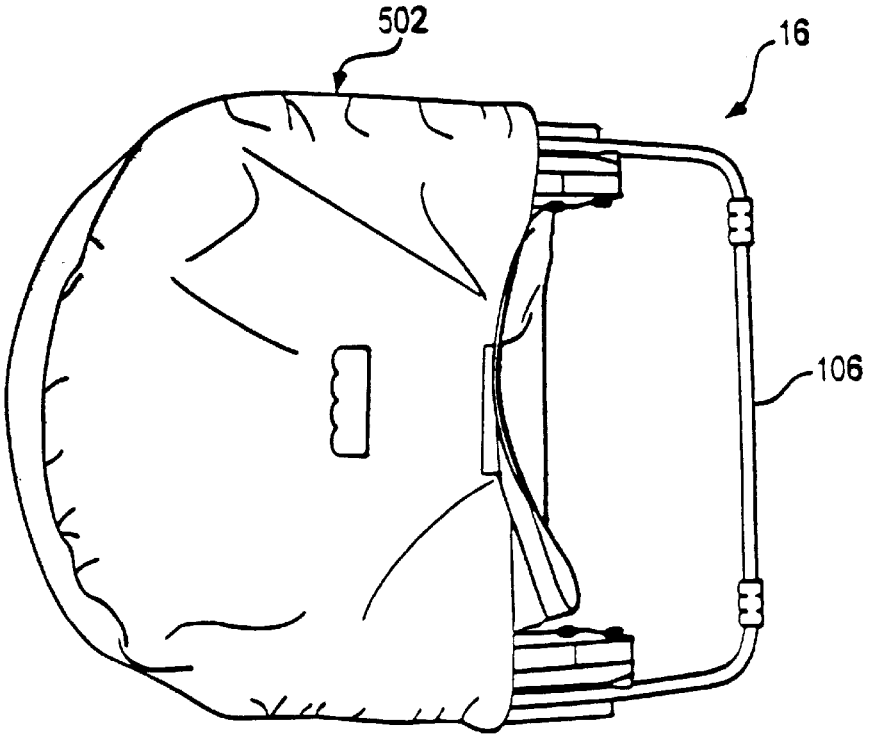
FIG. 31 is a top view of the infant product in the compact configuration with the main portion disposed in a carrying case in accordance with the invention.

In the compact folded configuration 16, the infant product includes a generally flat configuration having an end 500 and a handle 504 which is formed by back leg 106. End 500 may be slidably disposed within a carrying case 502 as illustrated in FIG. 31. Accordingly, handle 504 which extends outwardly from carrying case 502 can be used for carrying the infant product in compact folded configuration 16.

Carrying case 502 may be formed of nylon material and is used to protect and keep clean the folded infant device. When carrying case 502 is not in use, it may be stored on bassinet shell 202. In particular, a pocket may be formed, for example, by sewing on bottom surface 230 of bottom wall 204 of bassinet shell 202. Accordingly, carrying case 502 can be folded and slidably disposed within the pocket for storage during use of the infant product.

What is claimed is:

1. An infant-supporting device convertible between a compact configuration and a deployed configuration, comprising:

a suspension assembly including a first substantially U-shaped member and a second substantially U-shaped member releasably connected to each other at their ends, wherein the second member is disposed apart from the first member in the deployed configuration and is aligned with and substantially adjacent to the first member in the compact configuration;

a collapsible support frame movably connected to the suspension assembly, wherein the support frame supports the suspension assembly above a supporting surface in the deployed configurations, and the support frame includes a pair of legs which are disposed in a nested arrangement whereby the pair of legs lie in substantially the same plane in the compact configuration; and a receptacle having a support surface for supporting an infant and an annular wall, the annular wall being connected to the suspension assembly for supporting an infant, wherein the receptacle is suspended from the support assembly above the supporting surface in the deployed configuration and collapsed in the compact configuration, the suspension assembly, support frame and the receptacle being convertible together between the compact configuration and the deployed configuration.

2. An infant-supporting device according to claim 1, wherein the receptacle comprises a bassinet.

3. An infant-supporting device according to claim 1, wherein the receptacle comprises an infant seat.

4. An infant-supporting device according to claim 1, wherein the first and second members are pivotally connected to each other.

5. An infant-supporting device according to claim 1, wherein the support frame is pivotally connected to the suspension assembly.

6. An infant-supporting device according to claim 1, wherein the receptacle includes a support surface with a first end and a second end movably connected to the first end and an annular side wall having an upper edge connected to the suspension assembly and a lower edge connected to the support surface.

7. An infant-supporting device according to claim 6, wherein the first and second ends are movable about a first axis of rotation such that the support surface is disposable in a substantially flat position and a seated substantially non-planar position.

8. An infant-supporting device according to claim 7, wherein the first end includes a first lateral side and a second lateral side movably interconnected.

9. An infant-supporting device according to claim 8, wherein the first and second lateral sides are pivotal about a second axis intersecting the first axis.

10. An infant-supporting device according to claim 6, wherein the first end is disposed at an angle relative to the second end and the receptacle further comprises a receptacle adjustable to a closed position to support the first end at the angle.

11. An infant-supporting device according to claim 10, wherein the receptacle support includes a support strap.

12. An infant-supporting device according to claim 11, wherein a first end of the support surface is a substantially planar support surface and includes a first lateral side with a first relief portion and a second lateral side with a second relief portion, wherein the support strap in the closed position depresses against the first and second relief portions thereby forming lateral support members.

13. An infant-supporting device according to claim 12, further comprising a support pad disposed on the support surface.

14. An infant-supporting device according to claim 6, wherein the support surface is substantially planar.

15. An infant-supporting device according to claim 6, wherein the first end includes lateral support members.

16. An infant-supporting device according to claim 15, further comprising a removable pad disposed on the support surface including a cradle portion formed by the lateral support members.

17. An infant-supporting device according to claim 1, further comprising a canopy attached to the receptacle.

18. An infant-supporting device according to claim 1, wherein the support frame comprises a handle in the compact configuration.

19. An infant-supporting device according to claim 1, further comprising a carrying case adapted to receive at least the suspension assembly and the receptacle in the compact configuration.

20. An infant-supporting device according to claim 19, wherein the receptacle includes a pocket and the carrying case is stored in the pocket in the deployed configuration.

21. An infant-supporting device according to claim 1, wherein the receptacle includes a canopy convertible between an open position and a closed position.

22. An infant-supporting device according to claim 21, further comprising snaps to hold the canopy in the closed position.

23. An infant-supporting device according to claim 22, wherein the canopy includes support members to retain the canopy in a concave shape.

24. An infant-supporting device according to claim 23, wherein the support members comprise resilient elongated strips.

25. An infant-supporting device according to claim 1, wherein the support surface is convertible between a substantially planar position and a non-planar position.

26. A foldable infant product for supporting an infant that is foldable between a compact position and a deployed position, comprising:

an annular support rim having a first U-shaped rim member with a first open end and a second U-shaped rim member with a second open end, the first and second rim members being disposed in the deployed position with their open ends opposed, the second rim member being coupled to the first rim member for pivotal movement with respect to the first rim member, the second rim member being disposed adjacent a first side of the first rim member in the compact position;

a first support coupled to the first rim member for pivotal movement with respect thereto, the first support being disposed on a second side, opposite the first side of the first rim member in the compact position; and a second support coupled to the annular support rim and pivotable with respect thereto, the second support being disposed substantially parallel to and on the second side of the first rim member in the compact position and substantially parallel to the first rim member in the deployed position.

27. A foldable infant product according to claim 26, wherein the second rim member is disposed substantially parallel to the first rim member in the compact position.

28. A foldable infant product according to claim 26, wherein the first support is disposed substantially parallel to the first rim member in the compact position and substantially transverse to the first rim member in the deployed position.

29. A foldable infant product according to claim 26, wherein the first rim member is pivotally coupled to the second rim member by a joint including a detent for holding the second support in the compact position.

30. A foldable infant product according to claim 26, wherein the second support is pivotally coupled to the first rim member by a joint including a detent for holding the first support in the compact position.

31. A foldable infant product according to claim 26, wherein the second support is releasably secured to the first rim member in the deployed position by a snap pin connector.

32. A foldable infant product according to claim 26, further comprising:

an infant support suspended from the annular support rim for supporting an infant.

33. An infant product according to claim 26, wherein said second support is coupled to the annular support rim by a hub.

34. An infant product according to claim 26, wherein said first rim member is coupled to the second rim member by a hub.

35. An infant product according to claim 34, wherein said second support is coupled to the annular support rim by the hub.

36. An infant-supporting device convertible between a compact configuration and an deployed configuration, comprising:

a suspension assembly including a first substantially U-shaped member and a second substantially U-shaped member releasably connected to each other at their ends, wherein the second member is disposed apart from the first member in the deployed configuration and substantially adjacent the first member in the-compact configuration;

a collapsible support frame movably connected to the suspension assembly, wherein the support frame supports the suspension assembly above a supporting surface in the deployed configuration and the support frame is disposed substantially adjacent the first member in the compact configuration; and a receptacle for supporting an infant including a support surface and an annular side wall with an upper edge connected to the suspension assembly and a lower edge connected to the support surface, the support surface having a first end and a second end movably connected to the first end, wherein the receptacle is suspended from the support assembly above the supporting surface in the deployed configuration and the first end of the support surface is disposable at an angle relative to the second end and a pair of receptable support strap straps are attached to the receptacle and are interconnected to support the first end at the angle, the suspension assembly, support frame and the receptacle being convertible together between the compact configuration and the deployed configuration.

* * * * *

UNITED STATES PATENT AND TRADEMARK OFFICE
Certificate

Patent No. 5,947,552 Patented: September 7, 1999

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Julia Favorito, Buffalo, New York; John S. Canna, Orchard Park, New York; Sandra M. Darling, Freeport, Floida; Kenneth Von Felten, Cazenovia, New York; and Brian L. Badger, Erie, Pennsylvania.

Signed and Sealed this Twenty-seventh Day of August 2002.

PETER M. CUOMO
*Supervisory Patent Examiner*
Art Unit 3636